US010118413B2

(12) United States Patent
Shirane et al.

(10) Patent No.: US 10,118,413 B2
(45) Date of Patent: Nov. 6, 2018

(54) RECORDING APPARATUS

(71) Applicant: SEIKO EPSON CORPORATION, Tokyo (JP)

(72) Inventors: Tatsuya Shirane, Shiojiri (JP); Tetsuya Tamura, Matsumoto (JP); Toshio Miyake, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/621,847

(22) Filed: Jun. 13, 2017

(65) Prior Publication Data

US 2017/0361629 A1 Dec. 21, 2017

(30) Foreign Application Priority Data

Jun. 17, 2016 (JP) ..... 2016-120845

(51) Int. Cl.
*B41J 13/00* (2006.01)
*B41J 11/04* (2006.01)
*B41J 29/02* (2006.01)

(52) U.S. Cl.
CPC ..... *B41J 11/04* (2013.01); *B41J 13/0045* (2013.01); *B41J 29/023* (2013.01)

(58) Field of Classification Search
CPC .... B41J 11/04; B41J 11/0045; B41J 13/0045; B41J 29/023; B41J 13/025; B41J 3/60; B65H 5/062
See application file for complete search history.

(56) References Cited

U.S. PATENT DOCUMENTS 6,305,684 B1 * 10/2001 Lightner ..... B65H 3/06 271/122
2014/0292986 A1 10/2014 Oki et al.

FOREIGN PATENT DOCUMENTS

JP 61-132351 2/1985
JP 3810811 B 6/2006
JP 2014-208428 11/2014

* cited by examiner

*Primary Examiner* — Sharon A Polk
(74) *Attorney, Agent, or Firm* — Workman Nydegger

(57) ABSTRACT

A recording apparatus includes a medium container to store a medium, feeding rollers to be switched between a feeding state in which the feeding rollers are in contact with the medium and a separated state in which the feeding rollers are separated from the medium, a reversing path for reversing the medium that has been fed from the medium container, a recorder to perform recording on the medium that has been reversed by the reversing path, a back-feed path for introducing the medium that has been fed in the reverse direction from the recording region in which recording has been performed by the recorder toward the reversing path, and a nip roller configured to nip the medium within the back-feed path. At least a portion of the feeding rollers that are in the separated state overlaps the nip roller in the direction of the height of the recording apparatus.

8 Claims, 23 Drawing Sheets

RECORDING APPARATUS

BACKGROUND

1. Technical Field

The present invention relates to a recording apparatus for performing recording on a recording medium. More particularly, the present invention relates to a recording apparatus that includes a reversing path for bending and reversing a medium that has been fed from a medium storage section that stores the medium.

2. Related Art

In recording apparatuses such as facsimile machines and printers, for example, as in JP-A-2014-208428, a recording apparatus is provided with a paper cassette that stores paper, which is an example medium, in the bottom portion of the apparatus. From the paper cassette, the paper is fed by a feeding roller (a feeding roller 9), reversed by a large-diameter reversing roller (an intermediate roller 24), and transported toward a transport section (a transport-driving roller 26 and a transport-driven roller 27) that is provided before a recording head.

The recording apparatus in JP-A-2014-208428 includes a driven roller (25D) that is disposed directly below the reversing roller. When a recorded paper is fed back, the paper is nipped between the reversing roller and the intermediate roller and bent and reversed by using the reversing roller to transport the paper to the recording position. With these operations, two-sided printing can be performed.

While the demand for further size-reduced recording apparatuses has been increasing, there has been a tendency for the height of the apparatuses to increase, in particular, in the structure such as the recording apparatus in JP-A-2014-208428 that is provided with a driven roller directly below a reversing roller and further provided with a feeding roller below the driven roller.

SUMMARY

An advantage of some aspects of the invention is that a further size-reduced structure for reversing paper by using a reversing roller is provided.

A recording apparatus according to a first aspect of the invention for solving the above-mentioned problem includes a medium container configured to store a medium, feeding rollers configured to be switched between a feeding state in which the feeding rollers are in contact with the medium that is stored in the medium container and a separated state in which the feeding rollers are separated from the medium that is stored in the medium container, a reversing path for reversing the medium that has been fed from the medium container, a recorder configured to perform recording on the medium that has been reversed by the reversing path, a back-feed path for introducing the medium that has been fed in the reverse direction from the recording region in which recording has been performed by the recorder toward the reversing path, and a nip roller configured to nip the medium within the back-feed path. At least a portion of the feeding rollers that are in the separated state overlaps the nip roller in the direction of the height of the recording apparatus. Alternatively, according to another aspect of the invention, a recording apparatus includes a medium container configured to store a medium, feeding rollers configured to be switched between a feeding state in which the feeding rollers are in contact with the medium that is stored in the medium container and a separated state in which the feeding rollers are separated from the medium that is stored in the medium container, a reversing roller configured to reverse the medium that has been fed from the medium container, a recorder configured to perform recording on the medium that has been reversed by the reversing roller, a nip roller that is disposed on the side close to the medium container of the reversing roller, the nip roller being configured to nip with the reversing roller the medium that has been fed in the reverse direction from the recording region in which recording has been performed by the recorder. At least a portion of the feeding rollers that are in the separated state overlaps the nip roller in the direction of the height of the recording apparatus.

According to these aspects, at least a portion of the feeding rollers that are in the separated state overlaps the nip roller in the height direction of the recording apparatus. Consequently, the height of the nip roller and the height of the feeding roller do not vertically overlap each other in the height direction of the apparatus, and the height of the recording apparatus can be reduced.

According to a second aspect of the invention, the recording apparatus may further include a converge section in which the medium feeding path that has been fed from the medium container converges with the back feed path that has been fed in the reverse direction. The nip roller is disposed on the upstream side of the converge section. Furthermore, the nip roller is disposed such that the nip roller is shifted to the side toward which the medium is to be bent by the reversing roller with respect to the axial central portion of the reversing roller.

According to this aspect, the nip roller is disposed on the upstream side of the converge section. Consequently, at least a portion of the feeding rollers that are in the separated state overlaps the nip roller in the height direction of the recording apparatus. Accordingly, the height of the nip roller and the height of the feeding roller do not vertically overlap each other in the height direction of the apparatus, and the height of the recording apparatus can be reduced. Furthermore, the nip roller may be disposed such that the nip roller is shifted to the side toward which the medium is to be bent by the reversing roller with respect to the axial central portion of the reversing roller in the depth direction of the recording apparatus. With this structure, the feeding direction of the medium by the nip roller and the reversing roller follows the bending and reversing direction of the medium by the reversing roller, and the medium can be smoothly bent and reversed.

According to a third aspect of the invention, in the first aspect, the recording apparatus may further include a frame configured to support the nip roller. A driven roller may be provided in the frame on the side to face the medium that has been fed from the medium container.

According to this aspect, a frame configured to support the nip roller may be provided and a driven roller may be provided in the frame on the side to face the medium that has been fed from the medium container. Consequently, the frictional resistance caused by the medium that comes into contact with the frame can be reduced, and the medium can be further smoothly transported.

According to a fourth aspect of the invention, in the first aspect, the recording apparatus may further include a guide member having a guide surface for guiding the medium toward the position for nipping the medium by using the nip roller. The guide member is disposed above a roller unit configured to support the feeding roller and the guide member has a recessed portion for accommodating the roller unit while the feeding rollers are in the separated state.

According to this aspect, the guide member may be disposed above a roller unit configured to support the feeding roller and the guide member has a recessed portion for accommodating the roller unit while the feeding rollers are in the separated state. Consequently, while the thickness of the lower guide member can be ensured, the increase in the height of the recording apparatus due to the vertical overlap of the guide member and the roller unit can be reduced.

According to a fifth aspect of the invention, in the fourth aspect, the guide member may have openings or recesses for the feeding rollers to protrude from under the guide member toward the guide surface while the feeding rollers are in the separated state.

According to this aspect, the guide member may have openings or recesses for the feeding rollers to protrude from under the guide member toward the guide surface while the feeding rollers are in the separated state. Consequently, the height of the recording apparatus can be further reduced.

According to a sixth aspect of the invention, in the fifth aspect, while the feeding rollers protrude toward the guide surface, the feeding rollers may apply a transport force to the medium that has been fed from the recording region in the reverse direction.

According to this aspect, while the feeding rollers protrude toward the guide surface, the feeding rollers may apply a transport force to the medium that has been fed from the recording region in the reverse direction. Consequently, the recording apparatus can more reliably feed the medium in the reverse direction by using the feeding rollers.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
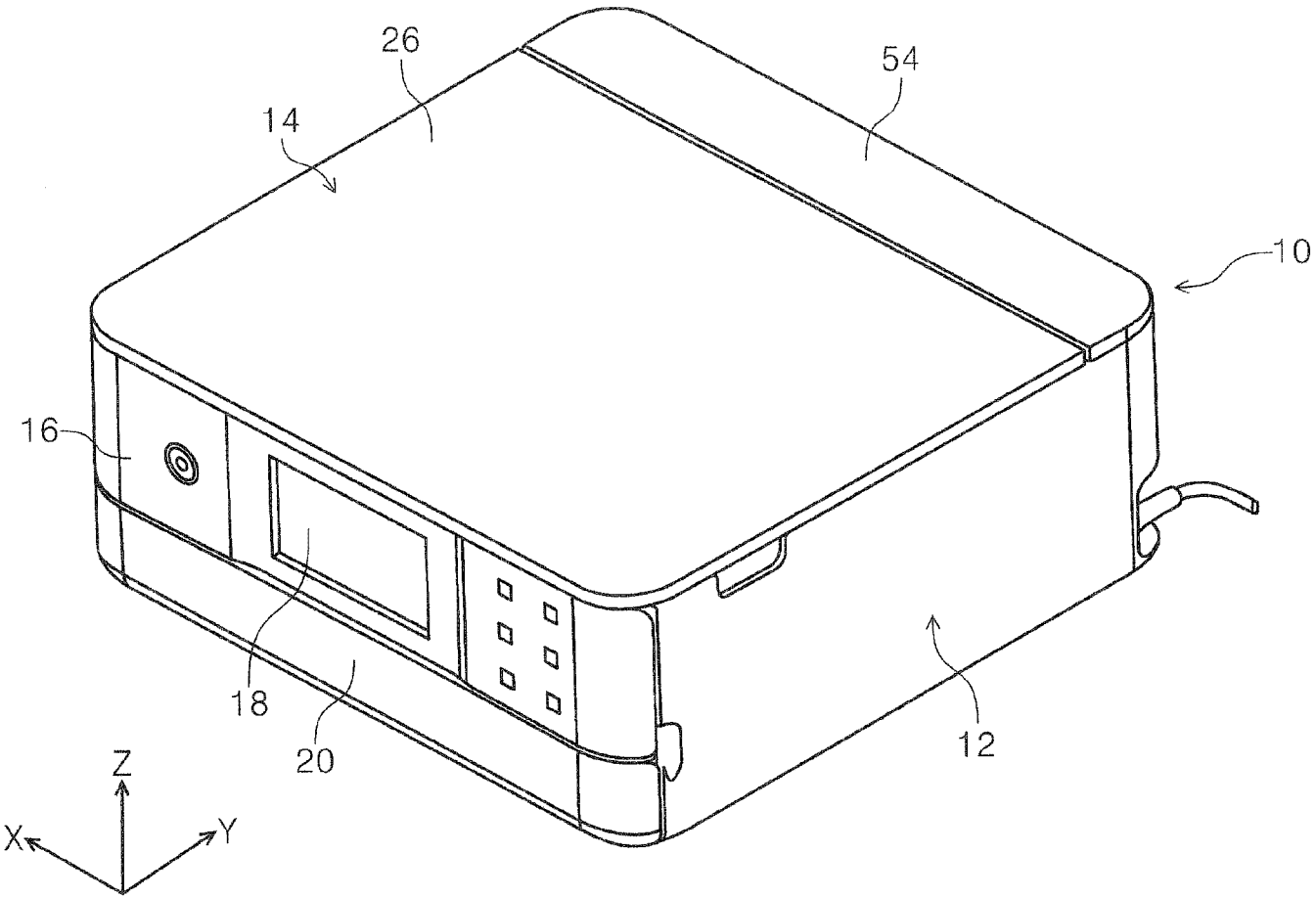
FIG. 1 is an external perspective view of a printer according to an embodiment of the invention.

Hereinafter, embodiments of the present invention will be described with reference to the attached drawings. In the embodiments described below, to the same components, the same reference numerals are given, and their descriptions will be made only in the first embodiment and will be omitted in the subsequent embodiments.

Figure 2:
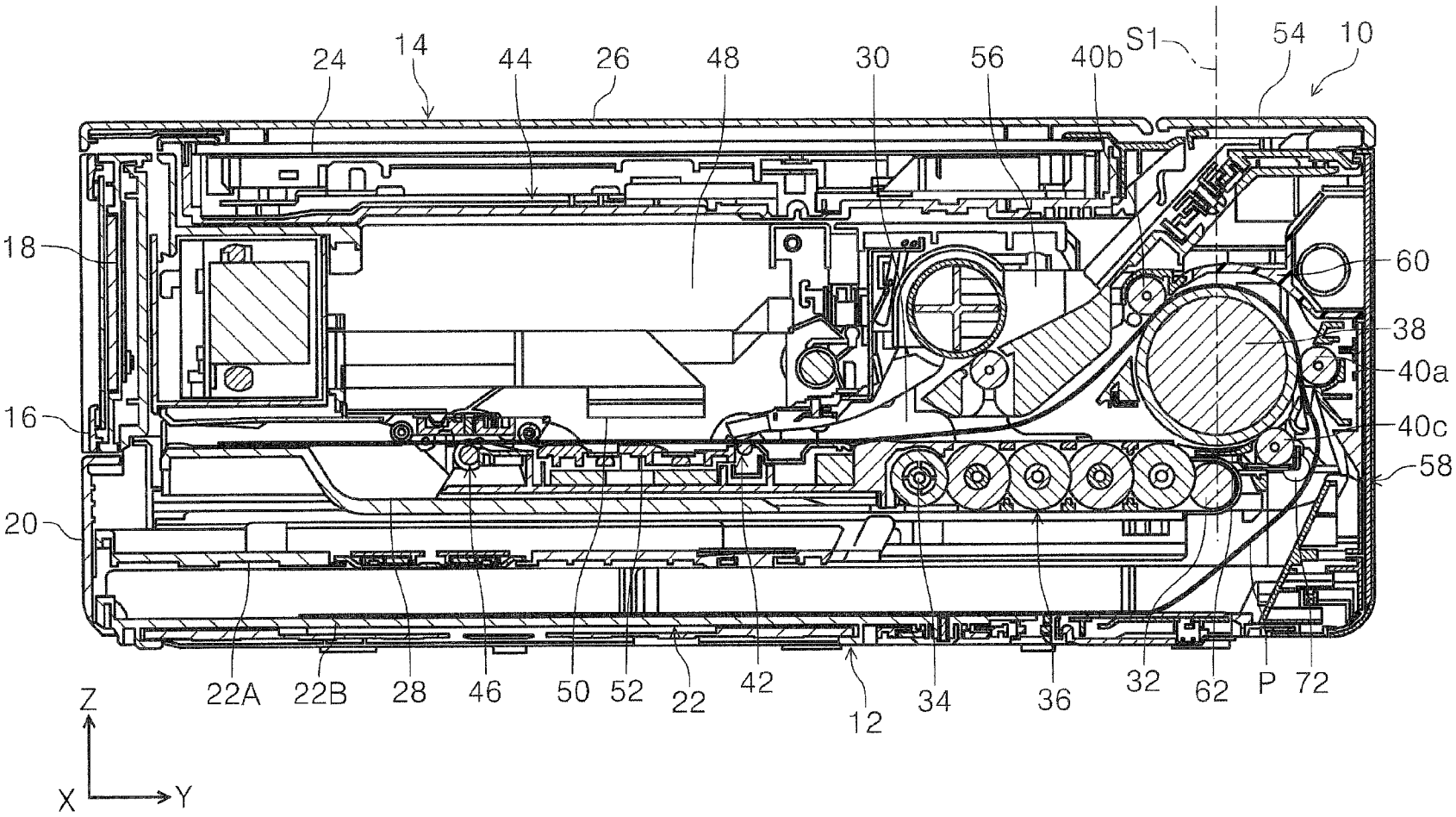
FIG. 2 is a side cross-sectional view of a medium transport path in the printer according to the embodiment of the invention.
Figure 3:
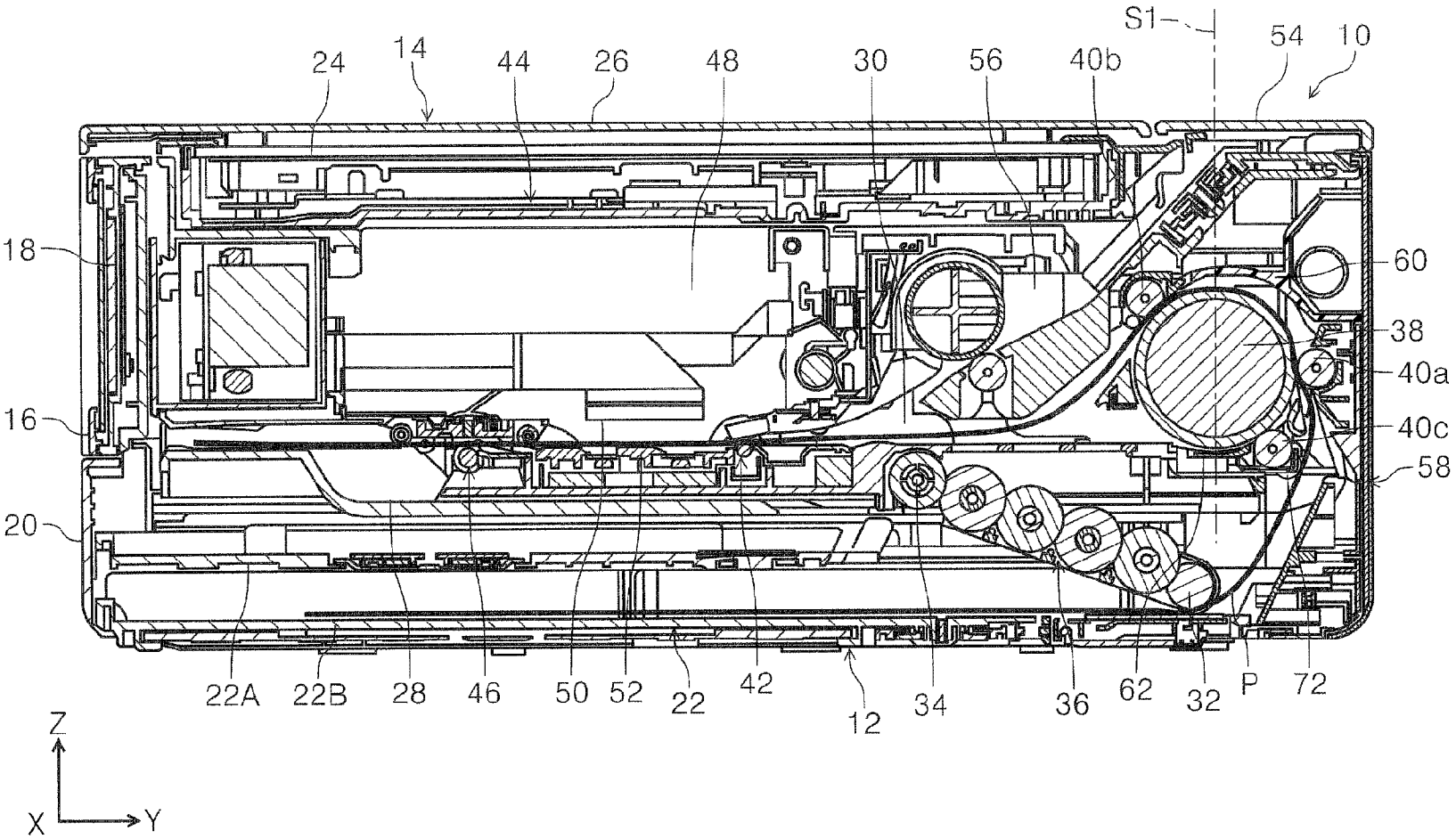
FIG. 3 is a side cross-sectional view of the medium transport path in the printer according to the embodiment of the invention.
Figure 4:
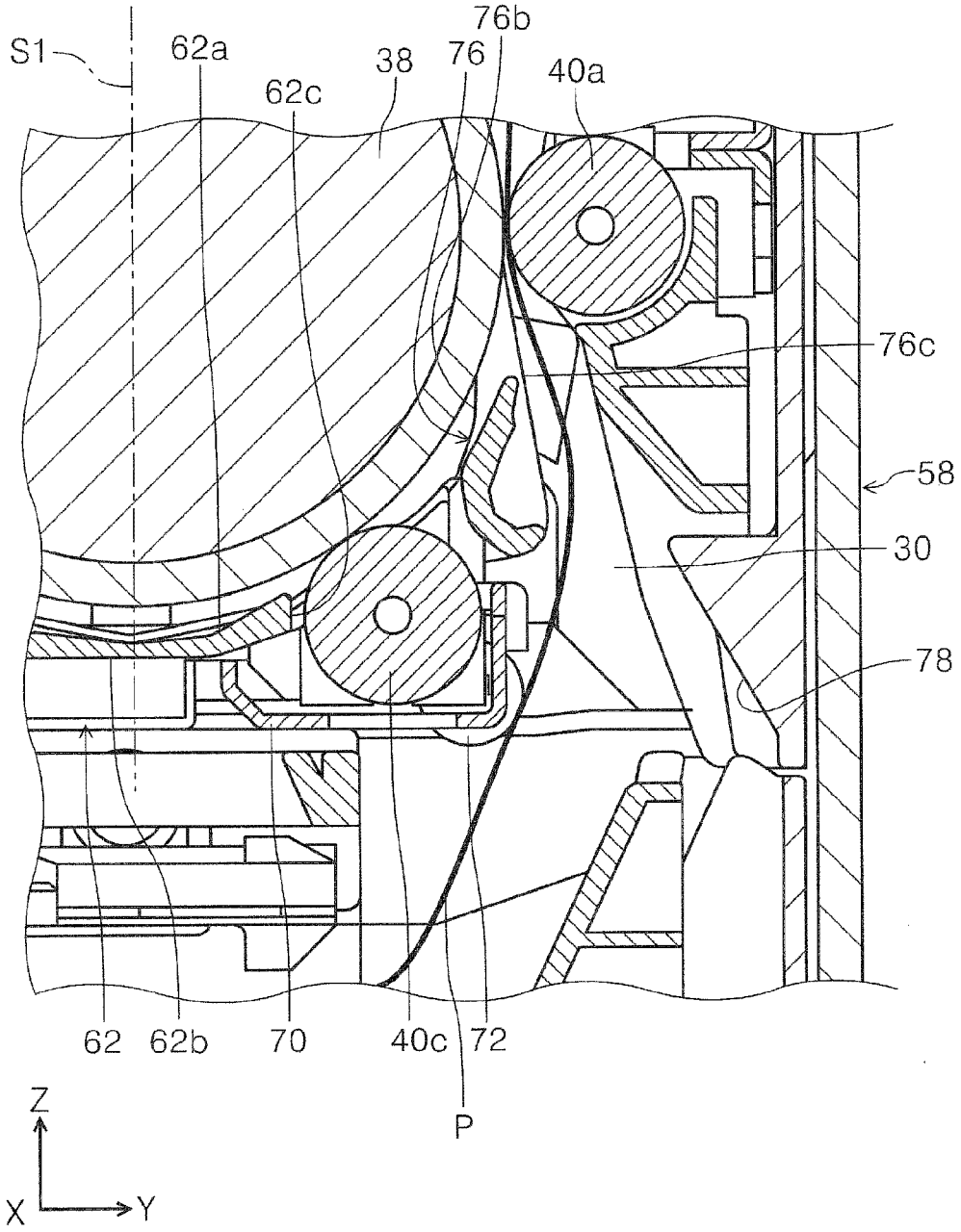
FIG. 4 is a side view of a driven roller that is provided in the medium transport path from a medium storage section toward a reversing roller.
Figure 5:
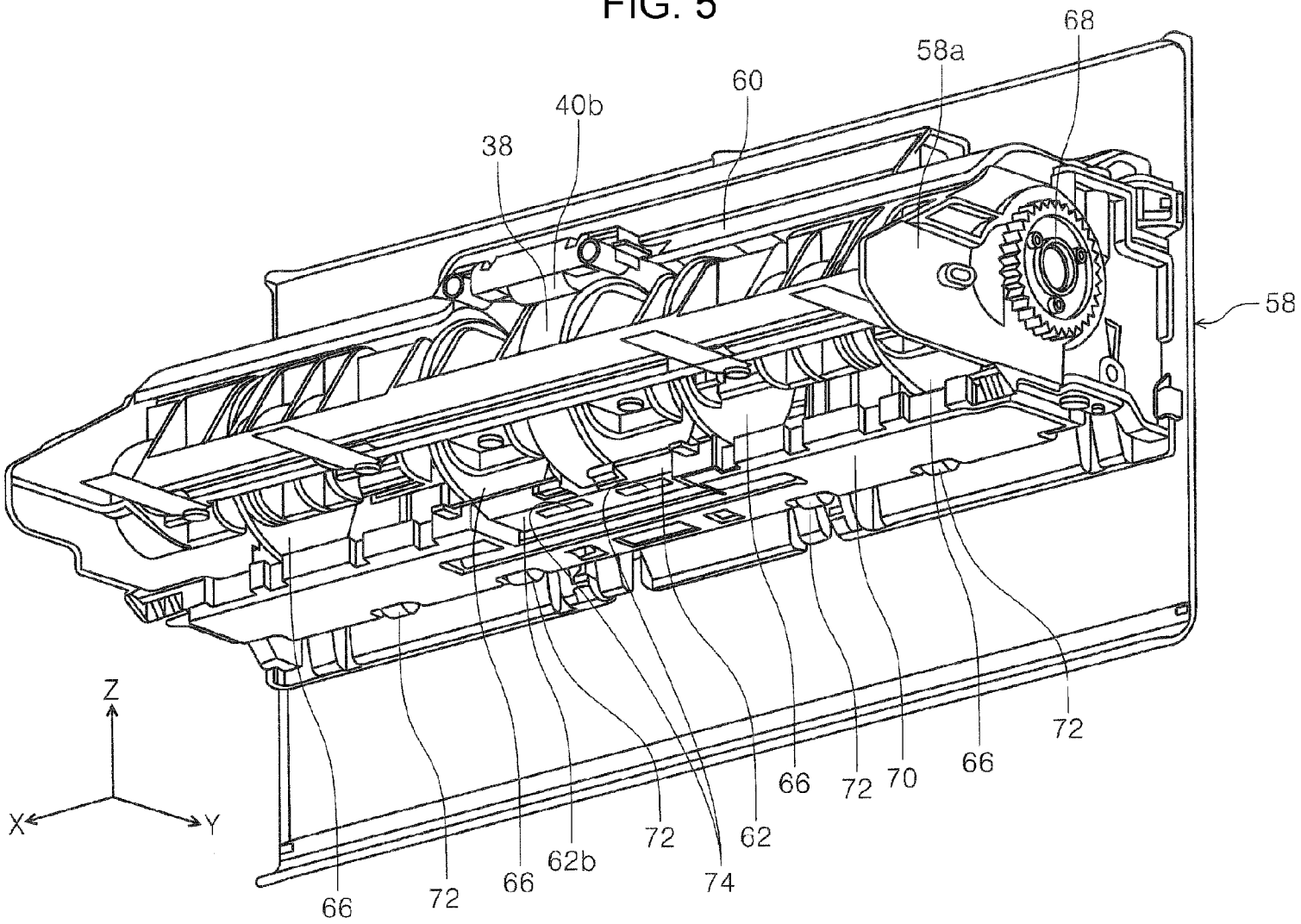
FIG. 5 is a perspective view of a unit.
Figure 6:
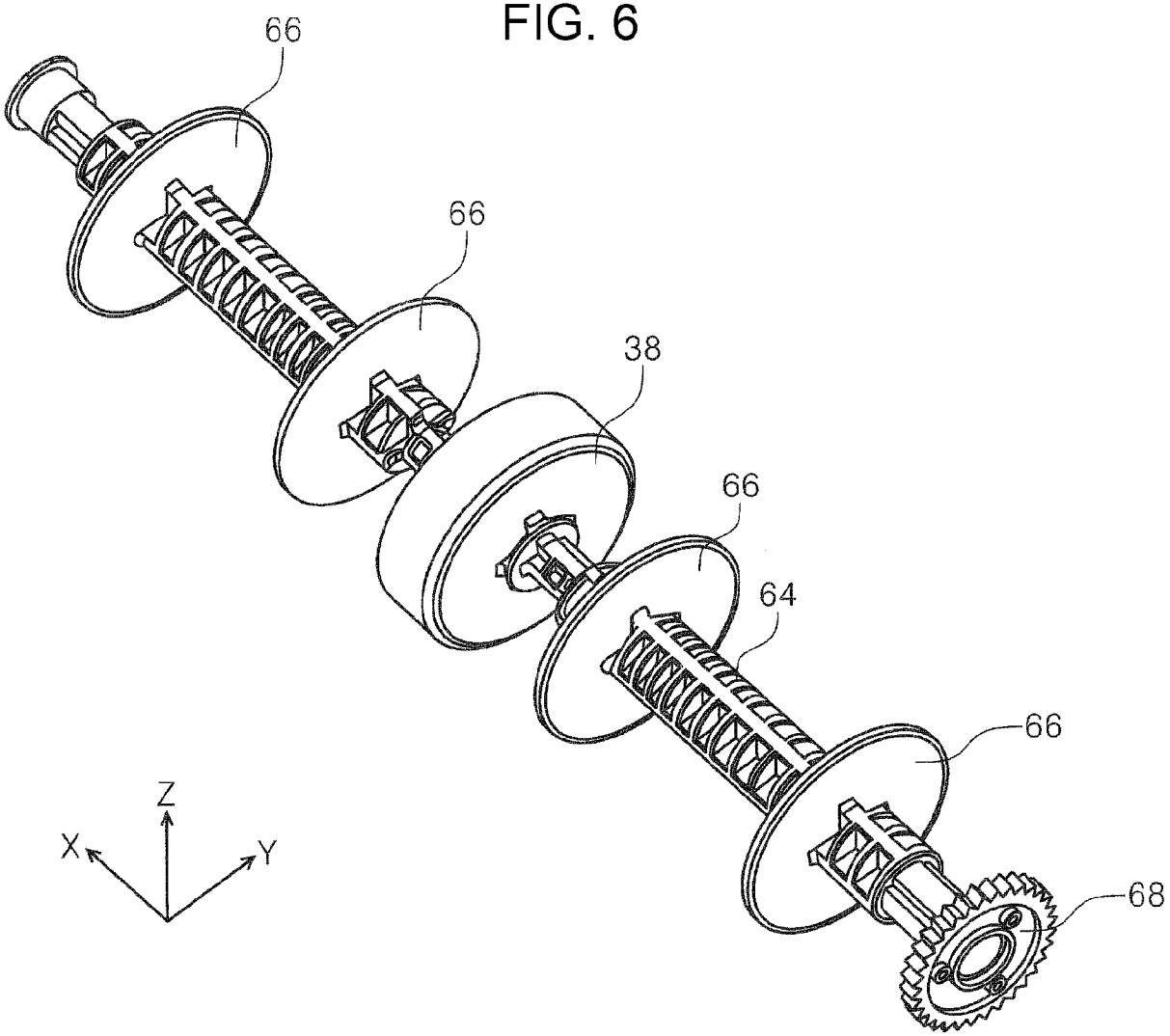
FIG. 6 is a perspective view of the reversing roller and assist rollers.
Figure 7:
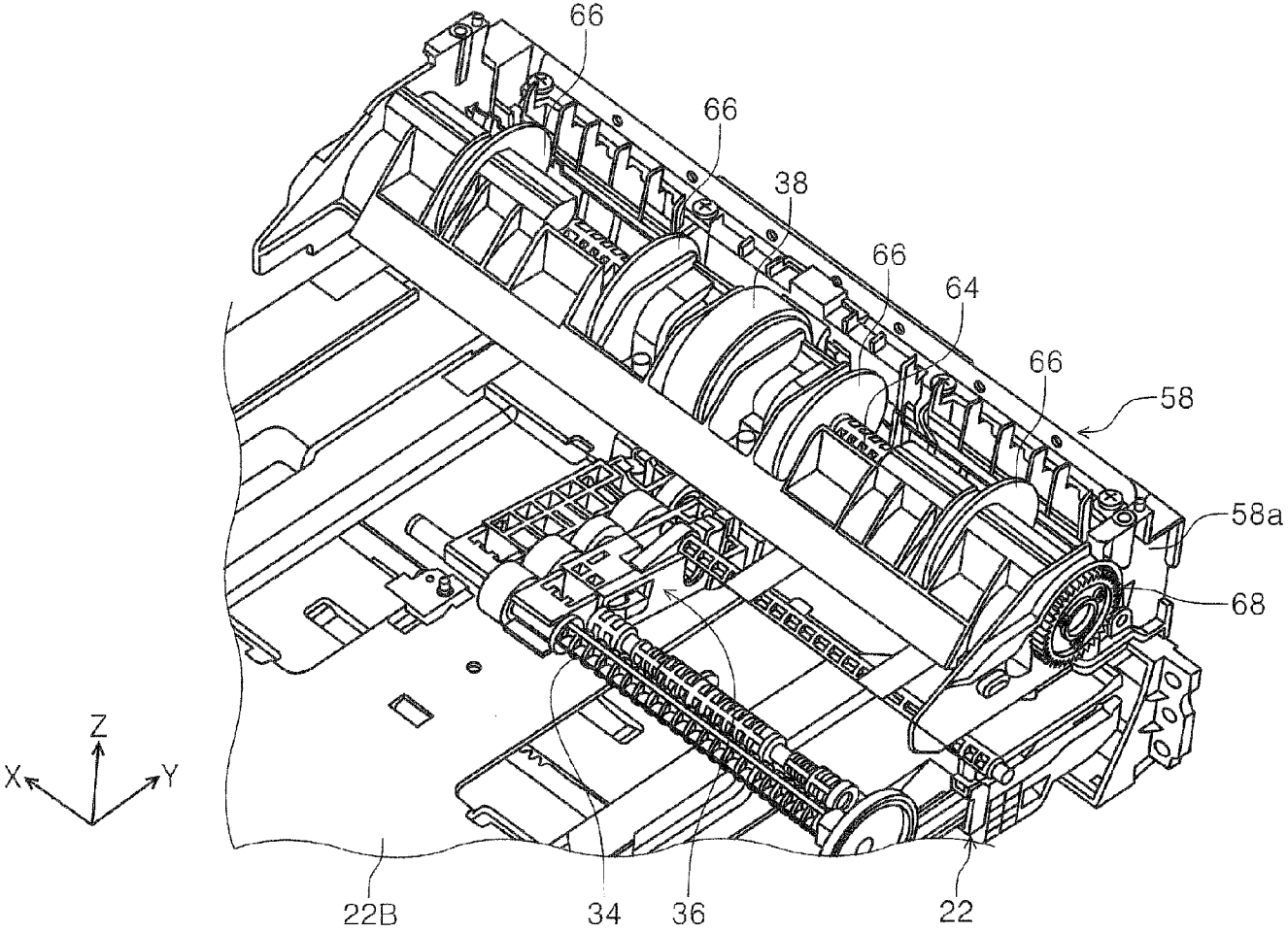
FIG. 7 is a perspective view of the reversing roller and the assist rollers in the unit.

FIG. 1 is an external perspective view of a printer according to an embodiment of the invention. FIG. 2 is a side cross-sectional view of a medium transport path in the printer according to the embodiment of the invention. FIG. 3 is a side cross-sectional view of the medium transport path in the printer according to the embodiment of the invention. FIG. 4 is a side view of a driven roller that is provided in the medium transport path from a medium storage section toward a reversing roller. FIG. 5 is a perspective view of a unit. FIG. 6 is a perspective view of the reversing roller and assist rollers. FIG. 7 is a perspective view of the reversing roller and the assist rollers in the unit.

Figure 8:
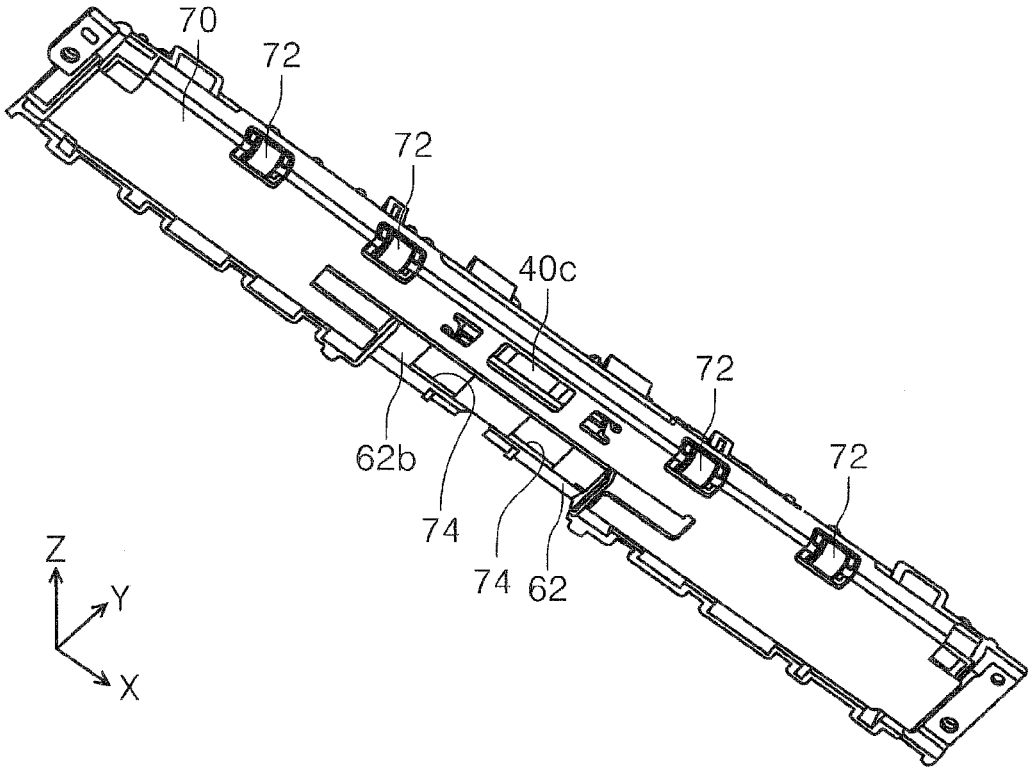
FIG. 8 is a perspective view of a frame that is provided with a third nip roller and driven rollers.
Figure 9:
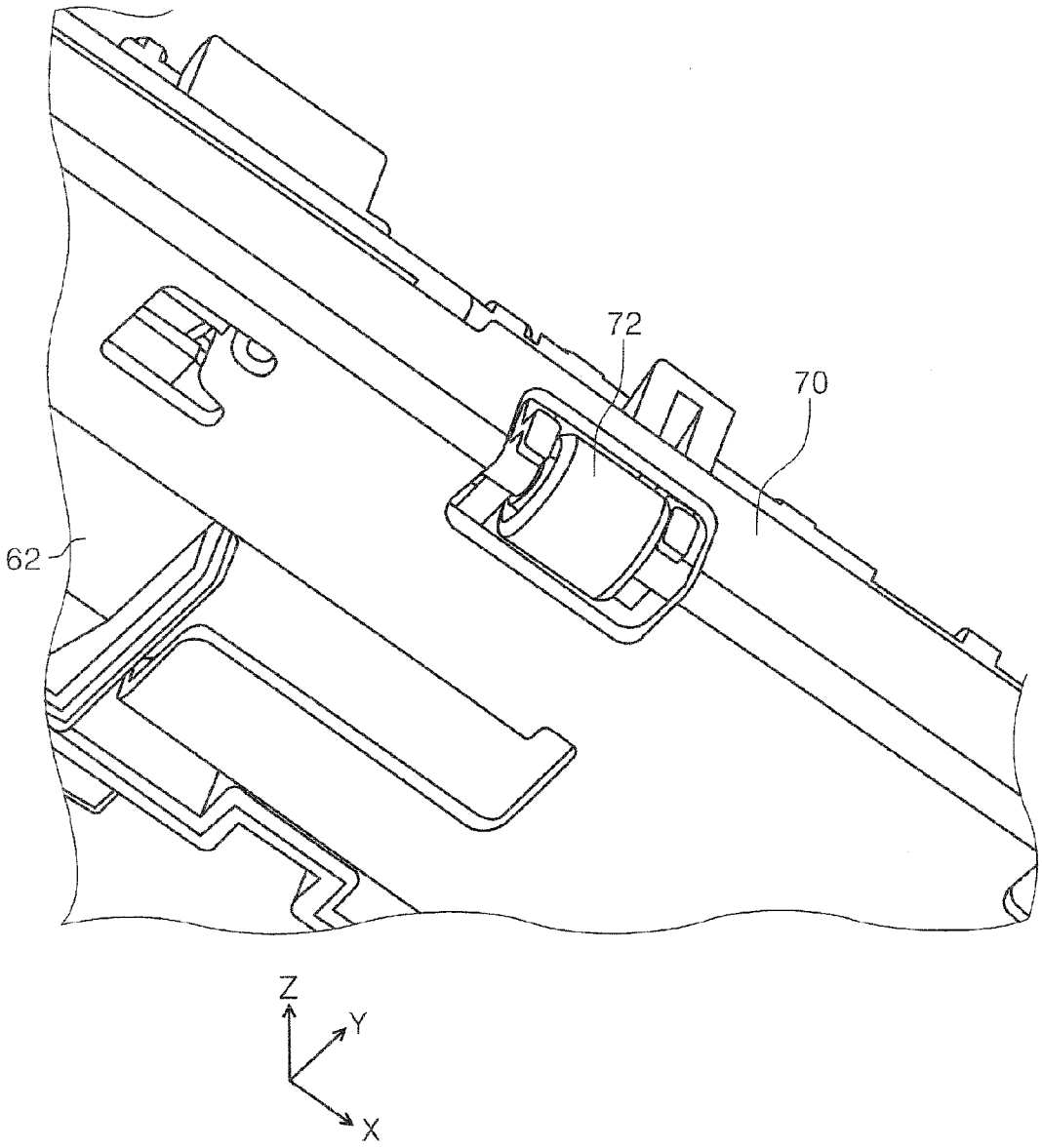
FIG. 9 is an enlarged view of the driven roller that is provided in the frame.
Figure 10:
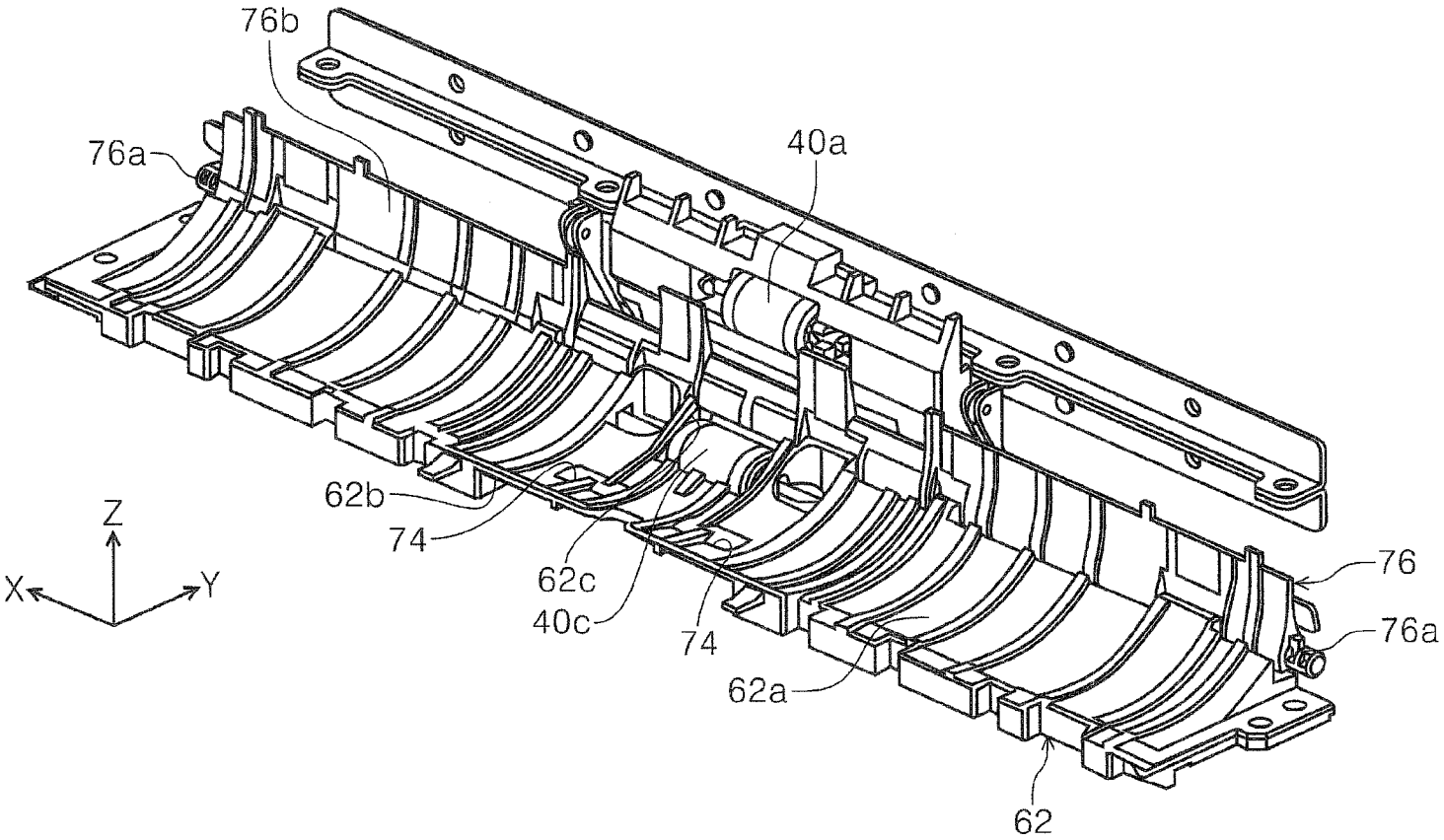
FIG. 10 is a perspective view of a lower guide member that constitutes a lower portion of the unit.
Figure 11:
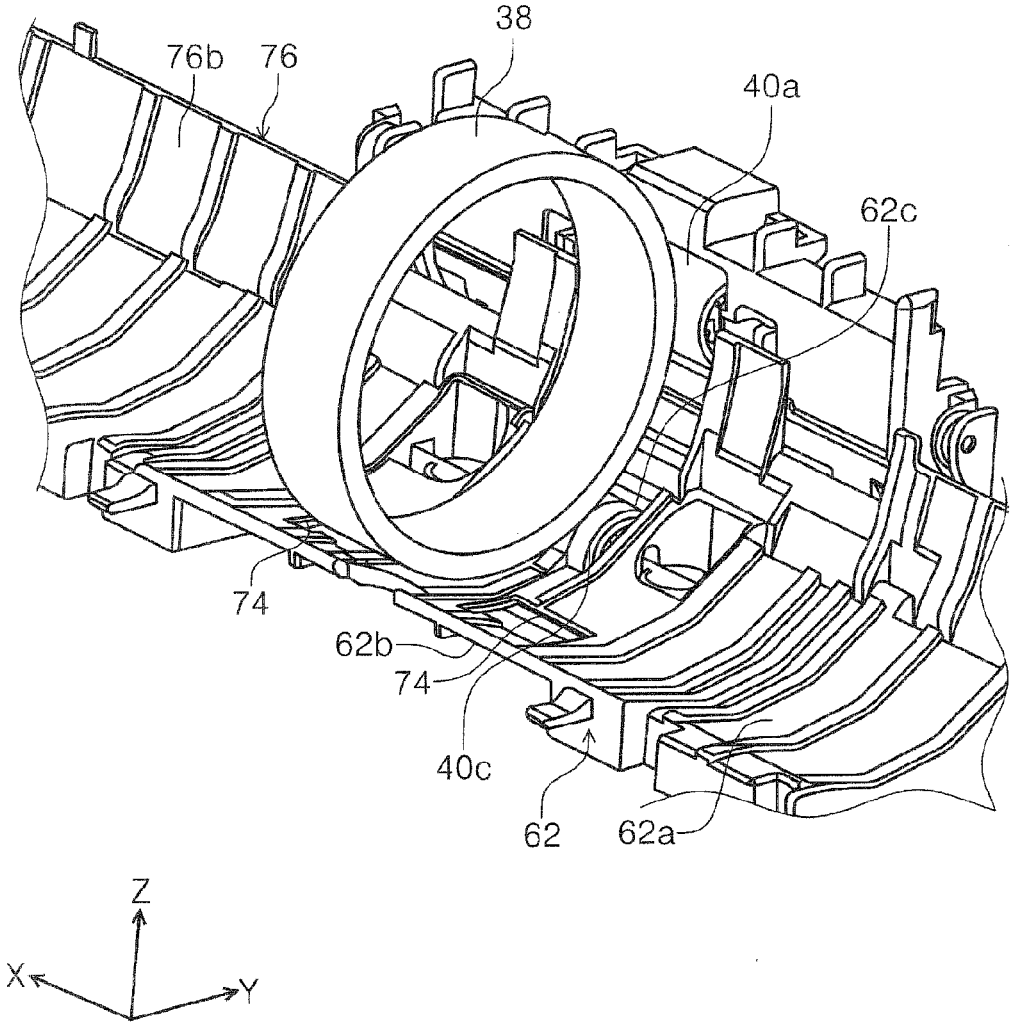
FIG. 11 is a perspective view of the reversing roller and a flap.
Figure 12:
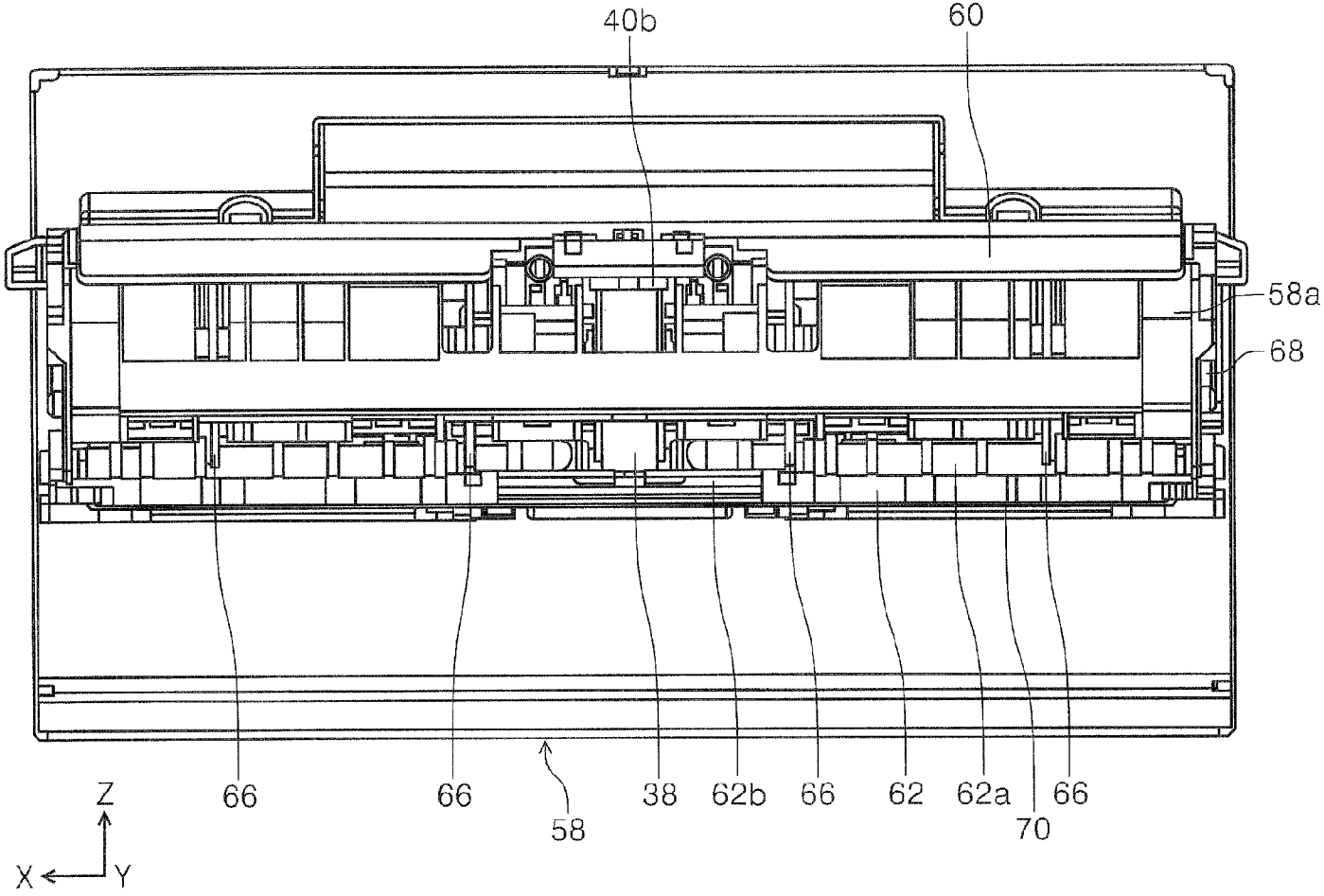
FIG. 12 is a front view of the unit viewed from the front side of the printer in the depth direction.
Figure 13:
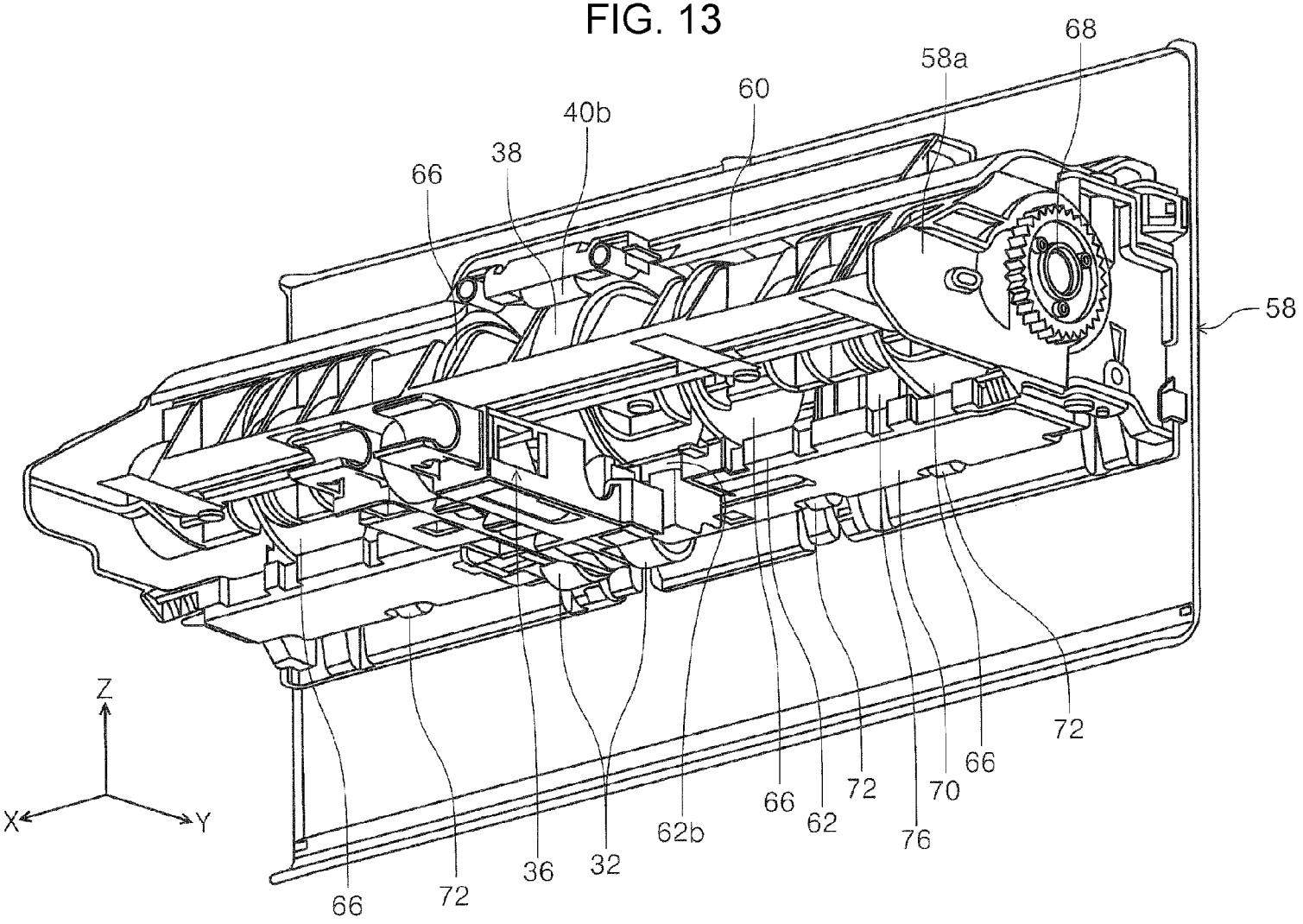
FIG. 13 is a perspective view of the unit and pickup rollers.
Figure 14:
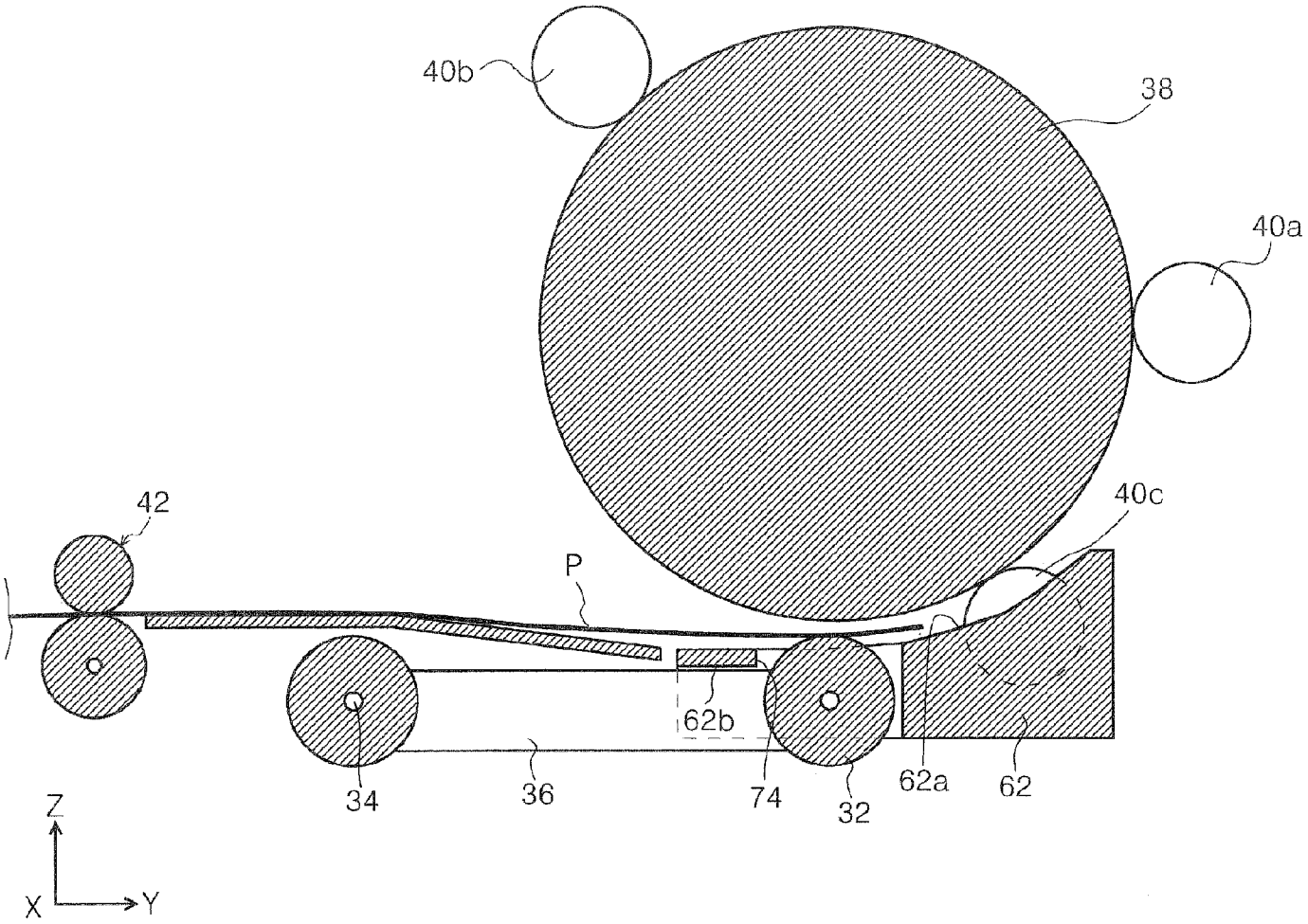
FIG. 14 is a schematic view of the pickup roller and the reversing roller in a state in which the rollers are separated from a medium.
Figure 15:
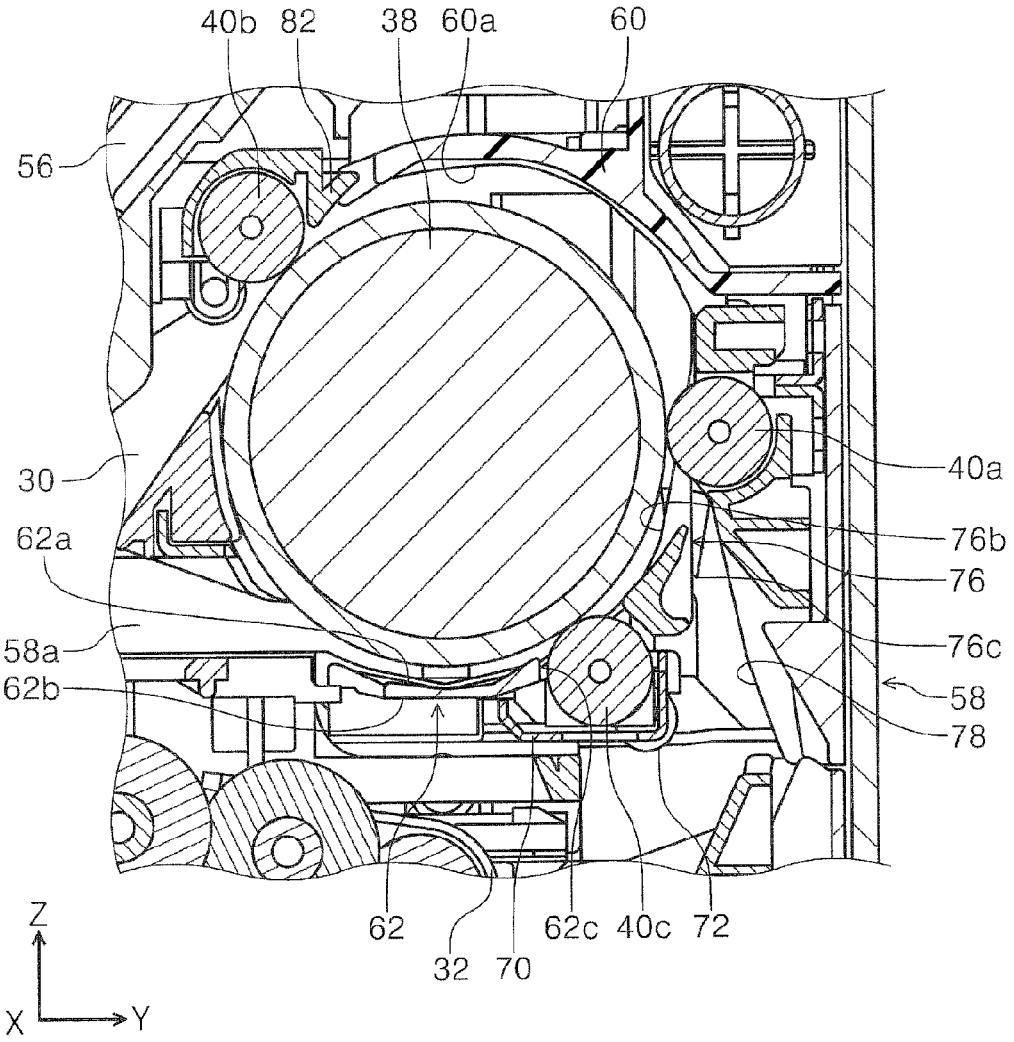
FIG. 15 is a side cross-sectional view of the flap that is provided adjacent to the reversing roller.
Figure 16:
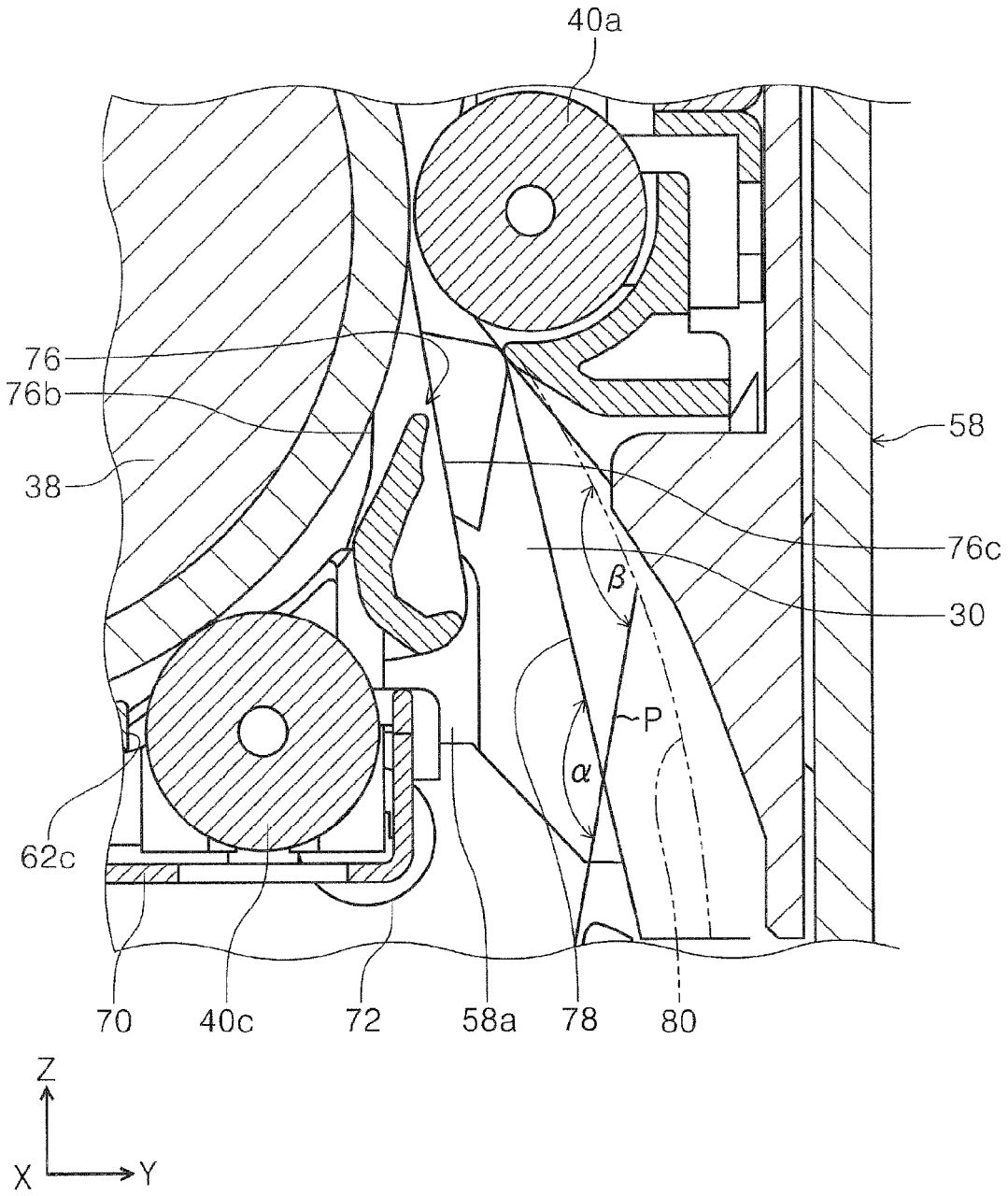
FIG. 16 is a side cross-sectional view illustrating a collision angle of the medium that has been transported from a medium storage section through a medium transport path against the reversing roller.

FIG. 8 is a perspective view of a frame that is provided with a third nip roller and driven rollers. FIG. 9 is an enlarged view of the driven roller that is provided in the frame. FIG. 10 is a perspective view of a lower guide member that constitutes a lower portion of the unit. FIG. 11 is a perspective view of the reversing roller and a flap. FIG. 12 is a front view of the unit viewed from the front side of the printer in the depth direction. FIG. 13 is a perspective view of the unit and pickup rollers. FIG. 14 is a schematic view of the pickup roller and the reversing roller in a state in which the rollers are separated from a medium. FIG. 15 is a side cross-sectional view of the flap that is provided adjacent to the reversing roller. FIG. 16 is a side cross-sectional view illustrating a collision angle of the medium that has been transported from a medium storage section through a medium transport path against the reversing roller.

Figure 17:
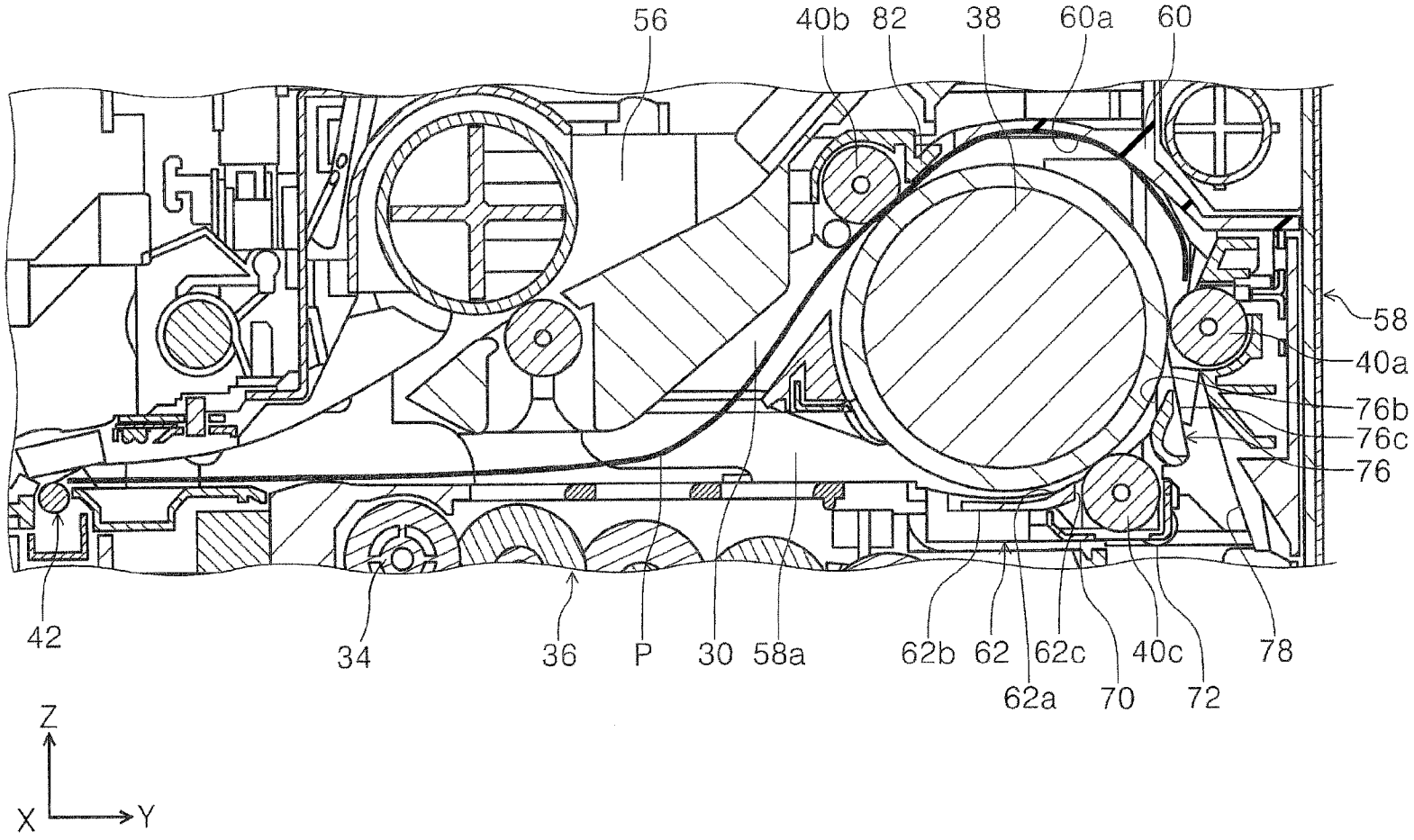
FIG. 17 is a side cross-sectional view of the reversing roller and around the reversing roller on the medium transport path.
Figure 18:
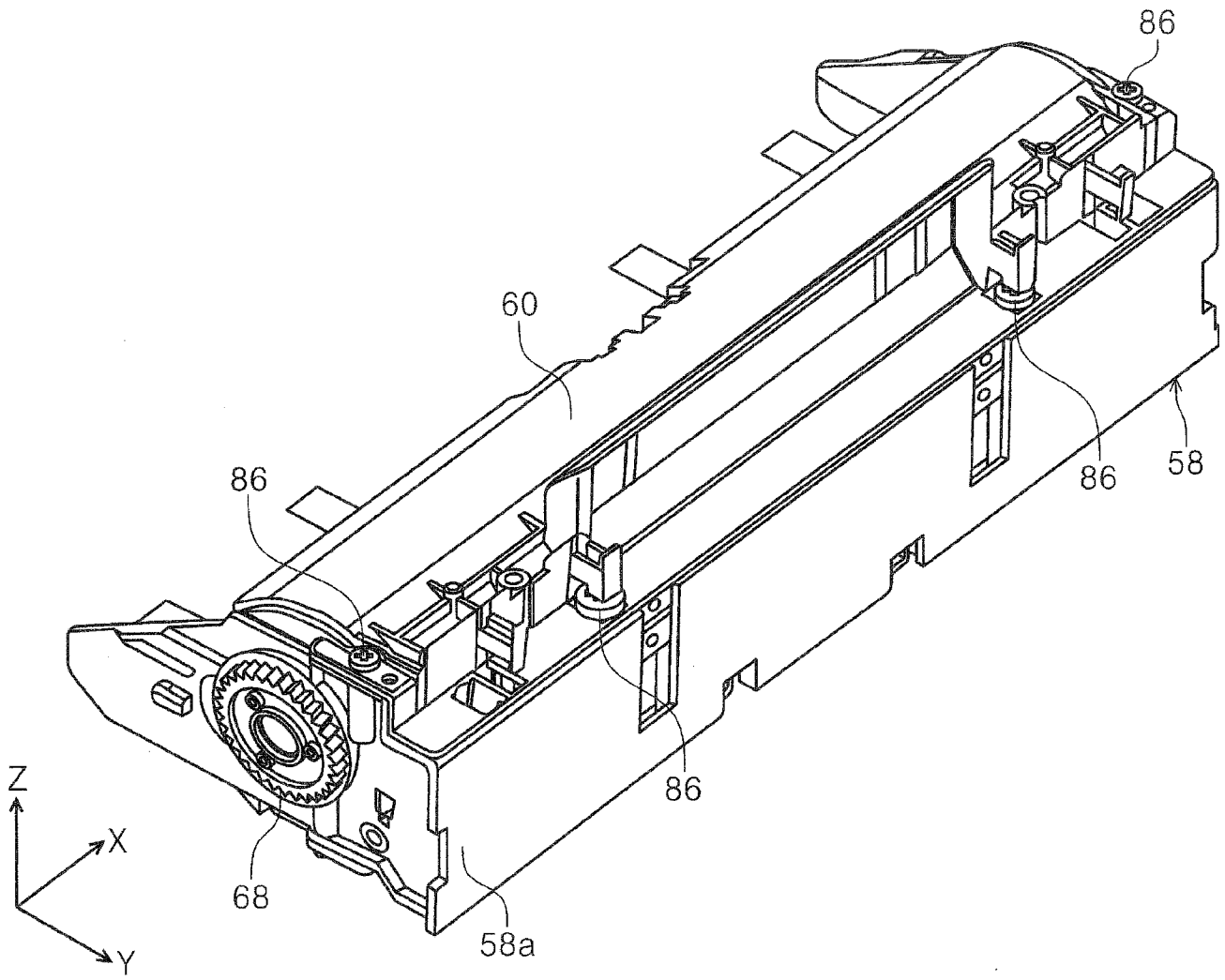
FIG. 18 is a perspective view of the unit viewed from the back side of the printer in the depth direction.
Figure 19:
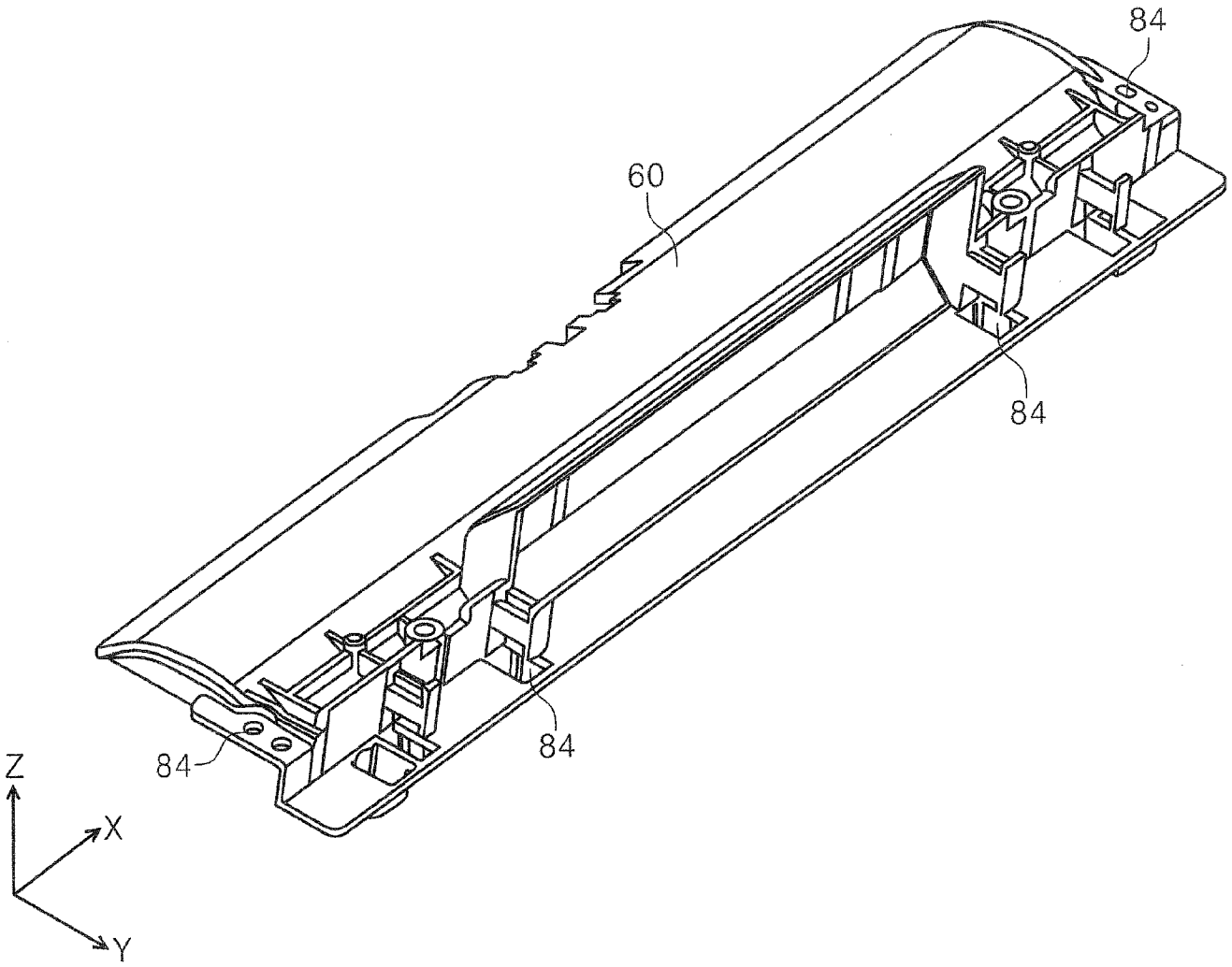
FIG. 19 is a perspective view of an upper guide member that constitutes an upper portion of the unit.
Figure 20:
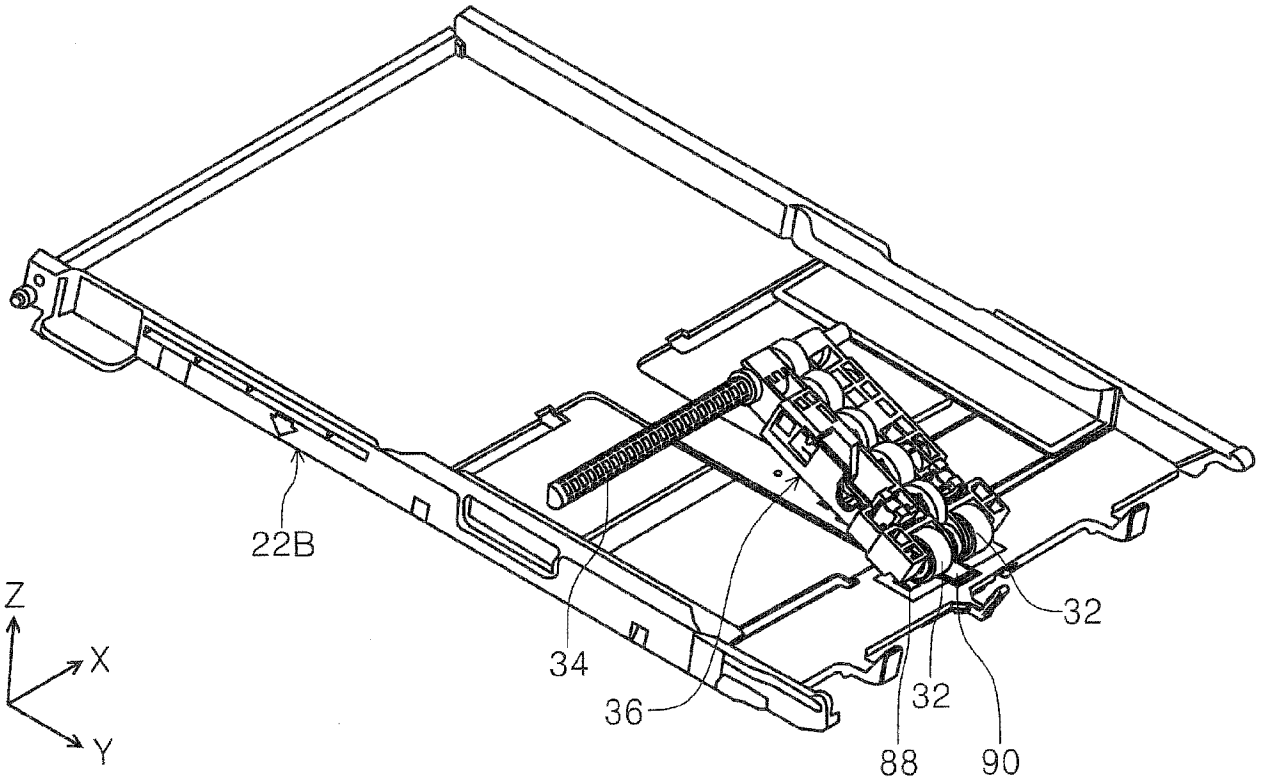
FIG. 20 is a perspective view of the pickup rollers that are in a feed position with respect to the medium storage section.
Figure 21:
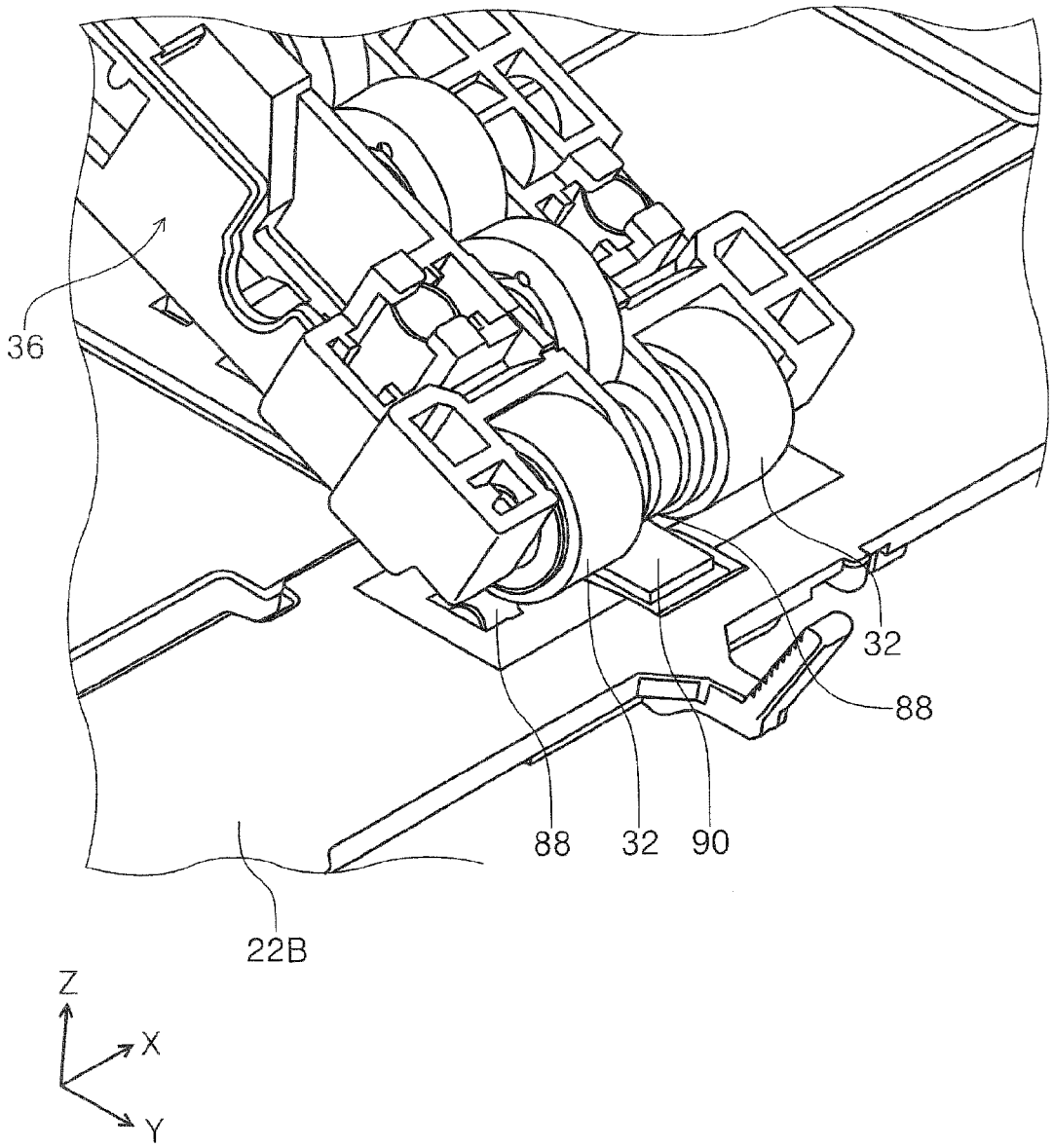
FIG. 21 is a perspective view of contact sections of the pickup rollers with respect to the medium storage section.
Figure 22:
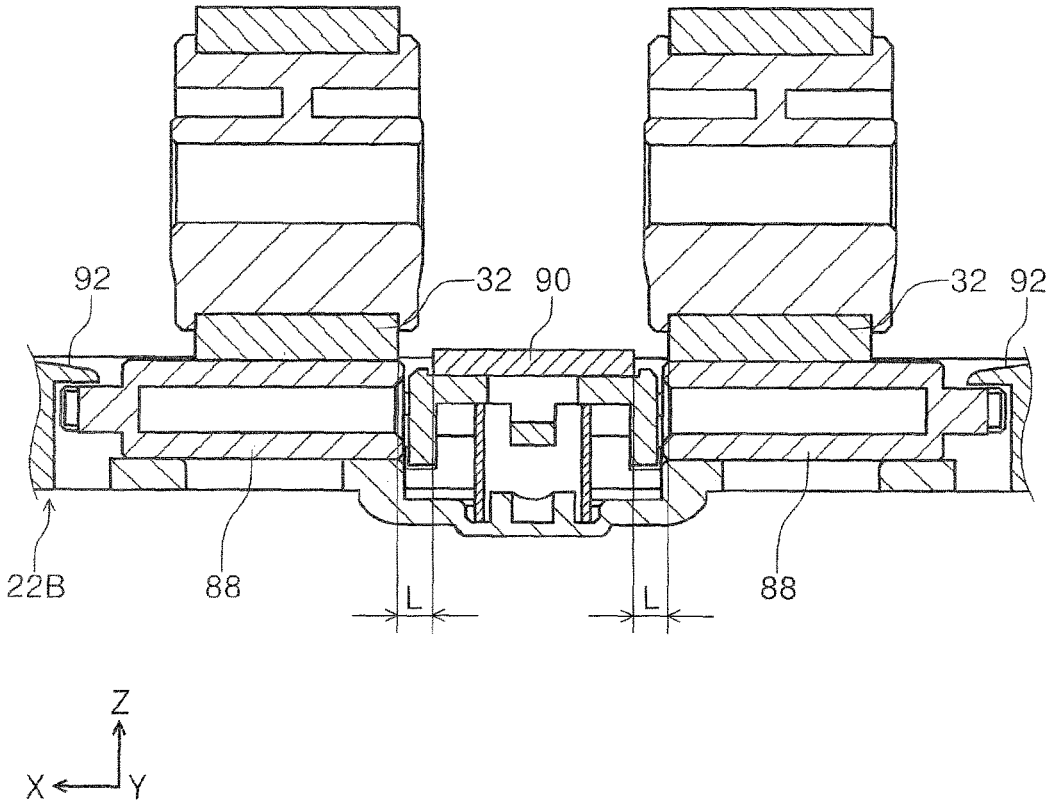
FIG. 22 is a cross-sectional view of the driven rollers of the medium storage section and the pickup rollers, which have come into contact with each other, viewed from the back side of the printer.
Figure 23:
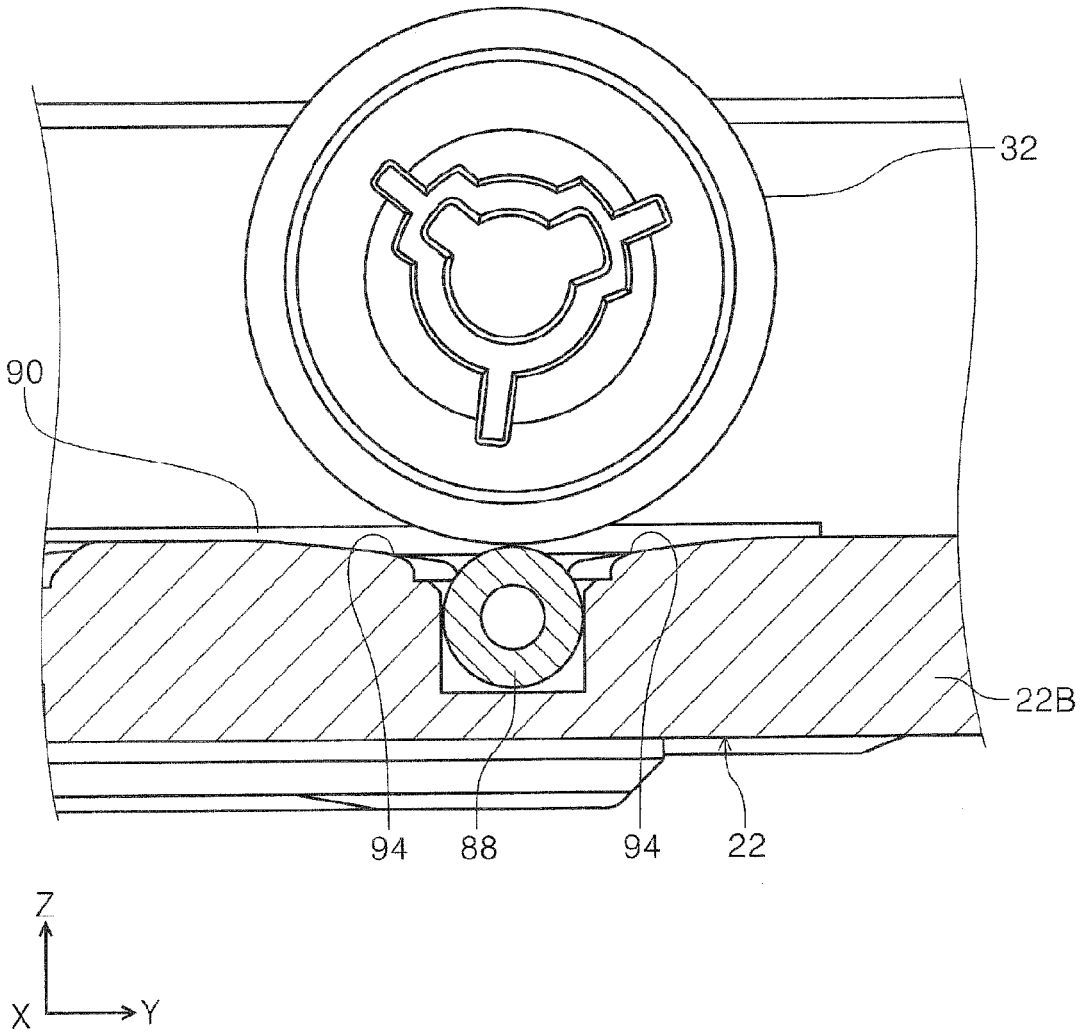
FIG. 23 is a side cross-sectional view of the driven rollers of the medium storage section and the pickup rollers, which have come into contact with each other, viewed from the side of the printer.

FIG. 17 is a side cross-sectional view of the reversing roller and around the reversing roller on the medium transport path. FIG. 18 is a perspective view of the unit viewed from the back side of the printer in the depth direction. FIG. 19 is a perspective view of an upper guide member that constitutes an upper portion of the unit. FIG. 20 is a perspective view of the pickup rollers that are in a feed position with respect to the medium storage section. FIG. 21 is a perspective view of contact sections of the pickup rollers with respect to the medium storage section. FIG. 22 is a cross-sectional view of the driven rollers of the medium storage section and the pickup rollers, which have come into contact with each other, viewed from the back side of the printer. FIG. 23 is a side cross-sectional view of the driven rollers of the medium storage section and the pickup rollers, which have come into contact with each other, viewed from the side of the printer.

In the XYZ coordinate system in the drawings, the X direction denotes the main scanning direction (moving direction) of a carriage, that is, the width direction of the recording apparatus, the Y direction denotes the medium transport direction, that is, the depth direction of the recording apparatus, and the Z direction denotes the height direction of the recording apparatus. In the drawings, the +X direction side denotes the apparatus left side, the −X direction side denotes the apparatus right side, the −Y direction side denotes the apparatus front side, the +Y direction side denotes the apparatus back side, the +Z direction side denotes the apparatus upper side, and the −Z direction side denotes the apparatus lower side.

Printer

Referring to FIG. 1, a printer 10 includes a housing 12 and a scanner section 14 that is provided in an upper portion of the housing 12. An operation section 16, which is rotatable (tiltable) with respect to the housing 12, is provided on the front side of the printer 10. More specifically, the position of the operation section 16 can be switched between a position (see FIG. 1) in which the operation section 16 is closed with respect to the housing 12 and a position (not illustrated) in which the operation section 16 is rotated with respect to the housing 12 in the −Y direction. The operation section 16 includes a display section 18 such as a display panel.

A cover 20 is provided under the operation section 16 on the front side of the housing 12. The cover 20 is attached to the front side of a medium storage section 22 (see FIG. 2 and FIG. 3) that stores a medium such that the cover 20 can rotate with respect to the medium storage section 22. The cover 20 is urged by an urging member (not illustrated) in a direction in which the cover 20 is closed with respect to the medium storage section 22. The medium storage section 22 is detachably attached to the housing 12 from the front side of the housing 12. As illustrated in FIG. 1, the cover 20 constitutes at least a portion of the front of the housing 12 when attached to the housing 12.

As illustrated in FIG. 2 and FIG. 3, the medium storage section 22 includes an upper medium storage section 22A and a lower medium storage section 22B, which serve as cassettes for storing media. The upper medium storage section 22A can be moved by a driving section (not illustrated), which is provided in the housing 12, in the +Y direction and −Y direction with respect to the lower medium storage section 22B. Specifically, the upper medium storage section 22A is disposed on the front side of the apparatus in the −Y direction and the position of the upper medium storage section 22A can be switched between a no feeding position (see FIG. 2 and FIG. 3) in which the stored medium is not fed and a feedable position to which the upper medium storage section 22A is moved in the +Y direction from the no feeding position to enable the medium to be fed. In the description below, if it is not necessary to specifically distinguish between them, the upper medium storage section 22A and the lower medium storage section 22B are described as the medium storage section 22.

As illustrated in FIG. 1 and FIG. 3, the scanner section 14 includes a platen 24 and a platen cover 26. The platen 24 is, for example, a transparent glass plate on which a document can be placed. The platen cover 26 can be rotated with respect to the platen 24, and the position of the platen cover 26 can be switched between a closed position to cover the platen 24 (see FIG. 1) and an open position to expose the platen 24.

To read a document on the platen 24, a user rotates the platen cover 26 to open with respect to the platen 24 and to expose the platen 24, sets a document on the platen 24, and closes the platen cover 26.

A medium receiving tray 28 is provided in the housing 12. The position of the medium receiving tray 28 can be switched between a position in which the medium receiving tray 28 is accommodated in the housing 12 as illustrated in FIG. 2 and FIG. 3 and a position in which the medium receiving tray 28 is moved in the −Y direction (not illustrated). The medium receiving tray 28 can be moved out of the housing 12 when the operation section 16 is rotated in the −Y direction. The medium receiving tray 28 pushes the cover 20 in the −Y direction to move forward to the front side of the housing 12.

Medium Transport Path

With reference to FIG. 2 and FIG. 3, a medium transport path 30 for a medium in the housing 12 will be described. The solid heavy line P in FIG. 2 and FIG. 3 indicates an example passage of a medium that is transported along the medium transport path 30 from the medium storage section 22 to the medium receiving tray 28. The alternate long and short dashed line S1 in FIG. 2 and FIG. 4 indicates a central position of a reversing roller 38, which will be described below, in the Y direction.

A pickup roller 32, which serves as a "feeding roller" that is driven and rotated by a drive source (not illustrated), is provided above the medium storage section 22 in the +Z direction. The pickup roller 32 is rotatably supported at a tip portion in a roller unit 36 that pivots about a pivot shaft 34 (also see FIG. 7). As an example, as illustrated in FIG. 20, a plurality of pickup rollers 32 are provided at the tip portion in the roller unit 36 with a space therebetween in the X direction.

The roller unit 36 can be pivoted between a separation position in which the pickup rollers 32 are separated from the medium stored in the medium storage section 22 as illustrated in FIG. 2 and a feed position in which the pickup rollers 32 come into contact with the medium stored in the medium storage section 22 to feed the medium as illustrated in FIG. 3.

In the medium transport path 30, on the downstream side of the pickup rollers 32, a reversing path is formed and the reversing roller 38 is provided. Around the reversing roller 38, a first nip roller 40*a*, a second nip roller 40*b*, and a third nip roller 40*c* are provided such that the rollers can follow the reversing roller 38.

On the downstream side of the reversing roller 38 in the transport direction, a transport roller pair 42, a recording section 44 that provides a "recording region" (region opposite a recording head 50) in which recording is performed on a medium, and a discharging roller pair 46 are provided in this order. The medium that has been transported by the reversing roller 38 is transported to the recording section 44 via the transport roller pair 42.

The recording section 44 includes a carriage 48, the recording head 50, which serves as a "recorder", and a medium supporting member 52. The recording head 50 is provided in a lower portion of the carriage. The carriage 48 can reciprocate in the +X direction and the −X direction in the housing 12. The recording head 50 discharges ink in the −Z direction.

The medium supporting member 52 is disposed below the recording head 50 in a region that faces the recording head 50. The medium supporting member 52 supports the lower surface (the surface opposite to the recording surface) of the medium that has been transported by the transport roller pair 42 to the region that faces the recording head 50. The recording head 50 discharges ink on the medium that is supported by the medium supporting member 52 and thereby recording is performed on the recording surface of the medium.

The recorded medium is nipped by a discharging roller pair 46 that is provided on the downstream side of the recording section 44 in the transport direction and the recording medium is discharged toward the medium receiving tray 28, which has been moved in the −Y direction.

As illustrated in FIG. 1 to FIG. 3, an upper cover 54 is attached to an upper portion of the housing 12 on the back side such that the upper cover 54 can rotate with respect to the housing 12. The upper cover 54 is lifted to load a medium in the housing 12. After the upper cover 54 has been rotated with respect to the housing 12 and the medium is loaded into the housing 12, the medium is guided through a medium guiding path 56 to the recording section 44 and recording is performed by the recording section 44. After the recording, the medium is discharged on the medium receiving tray 28.

After the recording has been performed on a first side (recording surface) of the medium by the recording section 44, to perform recording on a second side (lower surface), which is the other side of the first side, the transport roller pair 42 is reversed to feed the medium on a back-feed path to the upstream side in the transport direction. The medium that has been transported to the upstream side in the transport direction is nipped by the reversing roller 38 and the third nip roller 40*c*. The medium is reversed from the first side to the second side by the reversing roller 38 and transported to the recording section 44. After recording has been performed on the second side by the recording section 44, the medium is discharged toward the medium receiving tray 28.

Relationship Between Reversing Roller and Third Nip Roller

In FIG. 2 to FIG. 4, the third nip roller 40*c* is provided on a lower side of the reversing roller 38 in the +Z direction. The third nip roller 40*c* comes into contact with the reversing roller 38 on a side closer to the back side of the apparatus in the +Y direction with respect to the center line S1 of the reversing roller 38. That is, the third nip roller 40*c* is disposed such that the third nip roller 40*c* is shifted to the side toward which a medium is to be bent by the reversing roller 38 with respect to the central portion of the reversing roller 38 in the +Y direction.

Unit

The reversing roller 38, the first nip roller 40*a*, the second nip roller 40*b*, and the third nip roller 40*c* are provided in a unit 58 illustrated in FIG. 5. The unit 58 constitutes a portion of the back side of the housing 12 in the +Y direction in FIG. 2 and FIG. 3, and is detachably attached to the housing 12 from the back side.

The unit 58 includes a unit body 58*a*, an upper guide member 60, and a lower guide member 62. The reversing roller 38 is rotatably attached to the unit body 58*a*. The reversing roller 38 is provided, for example, in a central portion of the rotation shaft 64 in the axial direction as illustrated in FIG. 6. A plurality of assist rollers 66 are provided along the rotation shaft 64 in the axial direction with appropriate spaces therebetween with respect to the reversing roller 38. A drive gear 68 is provided at one end portion of the rotation shaft 64.

As illustrated in FIG. 5 and FIG. 7, the reversing roller 38, the rotation shaft 64, the assist rollers 66, and the drive gear 68 are rotatably attached to the unit body 58*a*. While the unit 58 is attached to the housing 12, a driving force transmission section (not illustrated), which is provided in the housing 12, engages with the drive gear 68. The reversing roller 38, the rotation shaft 64, the assist rollers 66, and the drive gear 68 are driven and rotated by a driving force from a drive source (not illustrated), which is provided in the housing 12.

When a medium is bent and reversed by the reversing roller 38, the assist rollers 66 regulate the movement of the medium in the +X direction and the −X direction on both sides of the reversing roller 38 to reduce the degree of cockling (wavy portions) of the medium to reduce the medium transport load.

With reference to FIG. 8 to FIG. 11, the lower guide member 62 will be described. The lower guide member 62 extends in the X direction. A frame 70 is attached to a lower portion of the lower guide member 62. The frame 70 extends in the X direction. The third nip roller 40*c* is rotatably attached to the frame 70 at a position corresponding to the reversing roller 38 in the X direction.

A plurality of driven rollers 72 are attached with appropriate spaces therebetween to the frame 70 on both sides of the third nip roller 40*c* in the X direction such that the driven rollers 72 can rotate with respect to the frame 70. As illustrated in FIG. 2 to FIG. 4, the driven rollers 72 are provided in the frame 70 that faces a medium that has been transported from the medium storage section 22 toward the reversing roller 38.

Referring to FIG. 4 again, the thick line P in FIG. 4 indicates a passage of a medium that has been transported from the medium storage section 22 toward the reversing roller 38. The medium that has been fed from the medium storage section 22 by the pickup rollers 32 is nipped and transported by the reversing roller 38 and the first nip roller 40*a*. This position is the converge section of a medium feeding path that has been fed from the medium storage section 22 and a back feed path that has been fed in the reverse direction. In feeding a medium, the speed of the pickup roller 32 that feeds the medium and the speed of the reversing roller 38 that feeds the medium may differ.

For example, if the medium-feeding speed of the pickup roller 32 is lower than the medium-feeding speed of the reversing roller 38, the medium is pulled to the side of the pickup roller 32. Accordingly, in the medium transport path 30, the medium stretches between the nip position of the reversing roller 38 and the first nip roller 40*a* and the pickup roller 32. The medium that is on the path between the nip position of the reversing roller 38 and the pickup roller 32 may come into contact with a portion of the apparatus in the −Y direction, that is, the frame 70.

The driven rollers 72 are, however, disposed in lower end portions of the frame 70 in the +Y direction, and consequently, in the medium transport path 30, when the medium that is on the path between the nip position of the reversing roller 38 and the pickup roller 32 stretches, the medium comes into contact with the driven rollers 72 before coming into contact with the frame 70. Since the driven rollers 72 are rotatably attached with respect to the frame 70, the driven rollers 72 guide the medium toward the nip position between the reversing roller 38 and the first nip roller 40*a*. Accordingly, the driven rollers 72 rotate when the medium comes into contact with the driven rollers 72, and thereby the transport load of the medium can be reduced and damage to the medium can be reduced.

In this embodiment, the driven rollers 72 are disposed in the lower end portions of frame 70 in the +Y direction; alternatively, a low-friction member may be provided.

Lower Guide Member

As illustrated in FIG. 10 and FIG. 11, a guide surface 62*a* that guides a medium is formed in an upper portion of the lower guide member 62. The guide surface 62*a* has an opening 62*c* that corresponds to the reversing roller 38 in the X direction. At least a portion of the third nip roller 40*c* can protrude from the guide surface 62*a* through the opening 62*c* toward the reversing roller 38. When two-sided printing is performed on a medium, the guide surface 62*a* guides the medium that is transported from the recording section 44 toward the nip position between the reversing roller 38 and the third nip roller 40*c*.

As illustrated in FIG. 10 to FIG. 12, a recessed portion 62*b* is formed at a central portion in the X direction in the lower guide member 62 and in the −Y direction in the lower guide member 62. The recessed portion 62*b* is formed in a lower portion of the lower guide member 62. The recessed portion 62*b* has openings 74. The openings 74 may be recesses. Note that FIG. 11 illustrates only the outer peripheral portion of the reversing roller 38.

In FIG. 2, FIG. 13, and FIG. 14, the lower guide member 62 is located higher than at least a portion of the roller unit 36 and the pickup rollers 32 in the +Z direction. More specifically, as illustrated in FIG. 13 and FIG. 14, when the pickup rollers 32 are in the separated position in which the pickup rollers 32 are separated from a medium in the medium storage section 22, a portion of the roller unit 36 and a portion of the pickup rollers 32 are accommodated in the recessed portion 62*b* in the lower guide member 62.

In this state, at least a portion of the pickup rollers 32 protrudes from the guide surface 62*a* toward the reversing roller 38 through the openings 74 (see FIG. 10 and FIG. 11) in the recessed portion 62*b*. It is noted that FIG. 14 schematically illustrates the relationship among the pickup rollers 32, the reversing roller 38, the third nip roller 40*c*, and the lower guide member 62, and components other than these components are omitted.

In this state, at least a portion of the pickup rollers 32 overlaps the third nip roller 40*c* in the +Z direction.

In this embodiment, as illustrated in FIG. 14, at least a portion of the pickup rollers 32 protrudes from the guide surface 62*a* toward the reversing roller 38. With this structure, in another embodiment, when the medium is fed in the reverse direction from the recording section 44 toward the reversing roller 38 by the transport roller pair 42 (see the heavy line P), the pickup rollers 32 may come into contact with the medium that has been fed in the reverse direction to apply transport power.

Furthermore, in still another embodiment, without providing the third nip roller 40*c*, the pickup rollers 32 that are in the separated position may come into contact with the reversing roller 38 to feed the medium that has been fed from the recording section 44 in the reverse direction toward the first nip roller 40*a*.

Flap

With reference to FIG. 4, FIG. 10, FIG. 11, and FIG. 15, a flap 76 will be described. The flap 76 is provided on the back side of the lower guide member 62 in the +Y direction in the unit 58. The flap 76 extends in the X direction, and includes pivot shafts 76*a* at both ends in the X direction. The flap 76 is attached to the unit 58 such that the flap 76 can pivot about the pivot shafts 76*a*.

In the flap 76, the front surface in the Y direction serves as a guide surface 76*b* that guides a medium from the third nip roller 40*c* to the first nip roller 40*a* in the medium transport path 30. In the flap 76, the back surface in the Y direction serves as a guide surface 76*c* that guides a medium from the medium storage section 22 to the first nip roller 40*a* in the medium transport path 30.

As illustrated in FIG. 4, when the flap 76 pivots in the −Y direction and is inclined toward the lower guide member 62, the flap 76 blocks the path from the third nip roller 40*c* to the first nip roller 40*a* in the medium transport path 30. This forms a path from the medium storage section 22 to the first nip roller 40*a* in the medium transport path 30.

As illustrated in FIG. 15, when the flap 76 pivots in the +Y direction from the position in FIG. 4, the flap 76 blocks the path from the medium storage section 22 to the first nip roller 40*a* in the medium transport path 30. This forms a path from the third nip roller 40*c* to the first nip roller 40*a* in the medium transport path 30.

In this embodiment, the third nip roller 40*c* is disposed in the +Y direction with respect to the reversing roller 38. With this structure, an upward transport force along the outer circumferential surface of the reversing roller 38 is applied to a medium that has been fed in the reverse direction from the recording section 44. As illustrated in FIG. 11, FIG. 15, and other drawings, the flap 76 is provided near the third nip roller 40*c* on the downstream side of the third nip roller 40*c* in the medium transport direction. Accordingly, the flap 76 can further easily change the direction of the upward transport force that is applied to the medium by the third nip roller 40*c* to a direction toward the nip position between the reversing roller 38 and the first nip roller 40*a*.

As illustrated in FIG. 16, in this embodiment, there is provided a guide surface 78 that guides a medium that has been transported from the medium storage section 22 toward the first nip roller 40*a* in the medium transport path 30. It is assumed that a contact angle which the guide surface 78 forms with the medium that has been transported from the medium storage section 22 is a contact angle $\alpha$, and as illustrated in FIG. 16, the guide surface indicated by the chain double-dashed line is a guide surface 80. The guide surface 80 is a virtual guide surface that is formed on the side closer to the back side of the apparatus in the +Y direction with respect to the guide surface 78. If it is assumed that a contact angle which the guide surface 80 forms with the medium that has been transported from the medium storage section 22 is a contact angle $\beta$, the contact angle $\alpha$ and the contract angle $\beta$ are $\alpha>\beta$.

That is, the contact angle which the guide surface 78 forms with the medium that has been transported from the medium storage section 22 is larger than that the virtual guide surface 80 (see the chain double-dashed line) forms with the medium that has been transported from the medium storage section 22. Consequently, the transport load can be reduced when the medium that has been transported from the medium storage section 22 comes into contact with the guide surface 78 and is transported toward the first nip roller 40*a*.

Relationship Between Reversing Roller and Upper Guide Member

In FIG. 17, the upper guide member 60 that constitutes a portion of the unit 58 is provided above the reversing roller 38 in the +Z direction in the medium transport path 30. The upper guide member 60 has a guide surface 60*a* on a side that faces the reversing roller 38. The guide surface 60*a* extends in the +Z direction with respect to the outer circumferential surface of the reversing roller 38.

An introduction section 82 that introduces a medium toward the second nip roller 40*b* is formed on the downstream side of the guide surface 60*a* in the transport direction. The introduction section 82 narrows the space between the reversing roller 38 and the guide surface 60*a* in the medium transport path 30 toward the nip position by the reversing roller 38 and the second nip roller 40*b*. In FIG. 17, the heavy line P indicates a medium in the medium transport path 30 in which the leading edge portion of the medium is nipped by the transport roller pair 42 for skew removing.

In FIG. 17, the portion of the guide surface 60*a* on the upstream side of the nip position between the reversing roller 38 and the second nip roller 40*b* upwardly extends in the +Z direction and the space between the reversing roller 38 and the guide surface 60*a* is wide. With this structure, when skew removing is performed on the medium P, the medium P can be easily rotated in the +X direction or in the −X direction with the second nip roller 40*b*. Consequently, the capability for removing a skew in the medium P can be increased.

Furthermore, the wide space between the reversing roller 38 and the guide surface 60*a* in the medium transport path 30 reduces the curvature of the curve of the medium that is bent by the reversing roller 38 and reduces the medium transport load.

The upper guide member 60 may be made of a low-friction member such as a polyoxymethylene (POM) to reduce friction between the guide surface 60*a* and the medium, which further increases the skew-removing capability and reduces the medium transport load.

In this embodiment, the guide surface 60*a* upwardly extends in the +Z direction to increase the space between the reversing roller 38 and the guide surface 60*a*; alternatively, the upper guide member 60 may be made of a low-friction member such as a POM to increase the medium skew-removing capability and to reduce the medium transport load even if the space between the guide surface 60*a* and the reversing roller 38 is narrowed.

Upper Guide Member

With reference to FIG. 18 and FIG. 19, the upper guide member 60 will be described. The upper guide member 60 constitutes an upper portion of the unit 58 and has the guide surface 60*a* on a side that faces the reversing roller 38. The upper guide member 60 extends in the X direction. In this embodiment, as an example, the upper guide member 60 is formed of a low-friction member such as a POM. However, the low-friction member such as the POM has a high shrinkage rate, warpage is likely to occur in the components, and the component accuracy tends to be low.

In this embodiment, as illustrated in FIG. 19, the upper guide member 60 has a plurality of fastening sections 84 at both end portions in the X direction and in the central portions in the X direction. The upper guide member 60 is connected to the unit body 58*a* by fastening members 86 such as screws through the fastening sections 84. With this structure, the upper guide member 60 is fastened to the unit body 58*a* not only at both ends but also at the central portions in the X direction to correct warpage in the upper guide member 60.

Relationship Between Pickup Roller and Medium Storage Section

With reference to FIG. 20 to FIG. 23, a relationship between the pickup roller 32 and the medium storage section 22 will be described. In the description below, an example case of the lower medium storage section 22B will be described. In FIG. 20 and FIG. 21, the pickup rollers 32 and the roller unit 36 are in the feed position with respect to the lower medium storage section 22B.

It is assumed that the lower medium storage section 22B has a rectangular box shape. A plurality of driven rollers 88 are rotatably provided to come into contact with the pickup rollers 32, which are in the feed positions, in a bottom portion of the lower medium storage section 22B. The driven rollers 88 are disposed to correspond to the pickup rollers 32 with a space in the X direction.

A high-friction member 90 is provided between the driven rollers 88 in the X direction. An example high-friction member 90 is made of cork material. The high-friction member 90 holds a bundle of media to prevent a portion of or the whole of the bundle of media from being transported to the downstream side in the transport direction when the media is fed by the pickup rollers 32.

In FIG. 22, the distance between a side of the pickup roller 32 and the high-friction member 90 in the X direction is set to a distance L. The shorter the distance L, the greater the contact force between the medium that has been fed by the pickup rollers 32 and the ends of the high-friction member 90, which increases the medium transport load. Furthermore, the recording surface would be damaged if the medium and the high-friction member 90 strongly come into contact with each other.

On the other hand, the longer the distance L, the smaller the medium transport load. However, if the medium transport load is reduced, when the medium on the lowermost medium that are stored in the lower medium storage section 22B is fed, the lowermost medium may be transported together with the upper medium, that is, double-feeding may occur. Consequently, the distance L is adjusted to adjust the medium transport load. In this embodiment, the distance L is set to an appropriate value to prevent double-feeding of the media and damage to the recording surface of the media.

When the pickup rollers 32 come into contact with the driven rollers 88, in some cases, a portion of the roller portions of the pickup rollers 32 is deformed by the pressing force of the pickup rollers 32, and the clearance between the bottom portion of the lower medium storage section 22B and the pickup rollers 32 is narrowed. To cope with the problem, in this embodiment, as illustrated in FIG. 22 and FIG. 23, relief portions 92 and 94 are formed in the Y direction and X direction around the driven rollers 88 in the bottom portion of the lower medium storage section 22B.

As illustrated in FIG. 22, in the bottom portion of the lower medium storage section 22B, each relief portion 92 is formed on the outside of each driven roller 88 in the X direction. For example, each of the relief portions 92 is tapered toward the driven roller 88 in the X direction and inclined downward in the −Z direction.

As illustrated in FIG. 23, in the bottom portion of the lower medium storage section 22B, the relief portions 94 are formed on the front side and the back side of each driven roller 88 in the Y direction. For example, each of the relief portions 94 is tapered toward the driven roller 88 in the Y direction and inclined downward in the −Z direction.

The relief portions 92 and 94 in the bottom portion of the lower medium storage section 22B can prevent the pickup rollers 32 from coming into contact with a portion of the lower medium storage section 22B other than the driven rollers 88 when the pickup rollers 32 come into contact with the driven roller 88. The example relief portions 92 and 94 are tapered; alternatively, any shape such as a step shape may be employed.

To summarize the above descriptions, the printer 10 may include the medium storage section 22 to store a medium, the pickup rollers 32 to be switched between the feeding state in which the pickup rollers 32 are in contact with the medium that is stored in the medium storage section 22 and a separated state in which the pickup rollers 32 are separated from the medium that is stored in the medium storage section 22, the reversing roller 38 to reverse the medium that has been fed from the medium storage section 22, the recording head 50 to perform recording on the medium that has been reversed by the reversing roller 38, the third nip roller 40*c* that is disposed on the side close to the medium storage section 22 of the reversing roller 38, the third nip roller 40*c* to nip with the reversing roller 38 the medium that has been fed in the reverse direction from the recording section 44 in which recording has been performed by the recording head 50. At least a portion of the pickup rollers 32 that are in the separated state overlaps the third nip roller 40*c* in the direction of the height of the printer 10. The printer 10 may include the medium storage section 22 to store a medium, the pickup rollers 32 to be switched between a feeding state in which the pickup rollers 32 are in contact with the medium that is stored in the medium storage section 22 and a separated state in which the pickup rollers 32 are separated from the medium that is stored in the medium storage section 22, the reversing path for reversing the medium that has been fed from the medium storage section 22, the recording head 50 to perform recording on the medium that has been reversed by the reversing path, the back-feed path for introducing the medium that has been fed in the reverse direction from the recording section 44 in which recording has been performed by the recording head 50 toward the reversing path, and the third nip roller 40*c* to nip the medium within the back-feed path. At least a portion of the pickup rollers 32 that are in the separated state overlaps the third nip roller 40*c* in the direction of the height of the printer 10.

With the above-described structures, at least a portion of the pickup rollers 32 that are in the separated state overlaps the third nip roller 40*c* in the height direction of the printer 10. Consequently, the height of the third nip roller 40*c* and the height of the pickup roller 32 do not overlap each other in the height direction of the printer 10, and the height of the printer 10 can be reduced.

The third nip roller 40*c* may be disposed such that the third nip roller 40*c* is shifted to the side toward which the medium is to be bent by the reversing roller 38 with respect to the center line S1, which is the axial central position of the reversing roller 38. With this structure, the feeding direction of the medium by the third nip roller 40*c* and the reversing roller 38 follows the bending and reversing direction of the medium by the reversing roller 38, and the medium can be smoothly bent and reversed.

The printer 10 may include the frame 70 to support the third nip roller 40*c*. The driven rollers 72 may be provided in the frame 70 on the side to face the medium that has been fed from the medium storage section 22. With this structure, the frictional resistance caused by the medium that comes into contact with the frame 70 can be reduced, and the medium can be further smoothly transported.

The printer 10 may include the lower guide member 62 having the guide surface 62*a* for guiding the medium toward the position for nipping the medium by using the third nip roller 40*c*. The lower guide member 62 is disposed above the roller unit 36 to support the pickup rollers 32 and has the recessed portion 62*b* for accommodating the roller unit 36 while the pickup rollers 32 are in the separated state. With this structure, while the thickness of the lower guide member 62 can be ensured, the increase in the height of the printer 10 due to the overlap of the lower guide member 62 and the roller unit 36 can be reduced.

The lower guide member 62 may have the openings 74 or recesses for the pickup rollers 32 to protrude from under the lower guide member 62 toward the guide surface 62*a* while the pickup rollers 32 are in the separated state. With this structure, the height of the printer 10 can be further reduced.

While the pickup rollers 32 protrude toward the guide surface, the pickup rollers 32 apply a transport force to the medium that has been fed from the recording section 44 in the reverse direction. With this structure, the printer 10 can more reliably feed the medium in the reverse direction by using the pickup rollers 32.

In the above-described embodiments, the third nip roller 40*c* and the driven rollers 72 are used in the ink jet printer that is an example recording apparatus of the invention; alternatively, the present invention may be applied to other liquid ejecting apparatuses. Such liquid ejecting apparatuses include printers that use an ink-jet recording head to discharge ink from the recording head to perform recording on a recording medium and recording apparatuses such as copying machines and facsimile machines, and further include apparatuses that eject liquid that corresponds to the use of the ink from a liquid ejecting head that corresponds to the ink-jet recording head on a recording medium to apply the liquid to the recording medium.

The liquid ejecting head may be, instead of the above-described recording head, a color material ejecting head that is used to manufacture a color filter for a liquid crystal display or the like, an electrode material (conductive paste) ejecting head that is used to manufacture an electrode for an organic electroluminescence (EL) display, a field emission display (FED) or the like, a bioorganic compound ejecting head that is used to manufacture a biochip, or a sample ejecting head that is used as a precision pipette.

It is to be understood that the present invention is not limited to the above-described embodiment, various modifications can be made within the scope of the following claims, and these modifications are included within the scope of the invention.

The entire disclosure of Japanese Patent Application No. 2016-120845, filed Jun. 17, 2016 is expressly incorporated by reference herein.

What is claimed is:

1. A recording apparatus comprising:

a medium container configured to store a medium;

feeding rollers configured to be switched between a feeding state in which the feeding rollers are in contact with the medium that is stored in the medium container and a separated state in which the feeding rollers are separated from the medium that is stored in the medium container;

a reversing path for reversing the medium that has been fed from the medium container;

a recorder configured to perform recording on the medium that has been reversed by the reversing path, wherein the recorder performs the recording in a recording region;

a back-feed path for introducing the medium that has been fed in the reverse direction from the recording region in which recording has been performed by the recorder toward the reversing path; and a nip roller configured to nip the medium within the back-feed path before the back-feed path converges with a medium transport path between the medium container and the recorder, wherein at least a portion of the feeding rollers that are in the separated state overlaps the nip roller in the direction of the height of the recording apparatus such that a bottom portion of the nip roller is below a top portion of the feeding rollers in the height direction, and the feeding rollers are positioned upstream of the nip roller with respect to the back-feed path.

2. The recording apparatus according to claim 1, further comprising:

a converge section in which a medium feeding path that has been fed from the medium container converges with the back feed path that has been fed in the reverse direction, wherein the nip roller is disposed on the upstream side of the converge section.

3. The recording apparatus according to claim 1, further comprising:

a frame configured to support the nip roller, wherein a driven roller is provided in the frame on a side to face the medium that has been fed from the medium container.

4. The recording apparatus according to claim 1, further comprising:

a guide member having a guide surface for guiding the medium toward the position for nipping the medium by using the nip roller, wherein the guide member is disposed above a roller unit configured to support the feeding rollers and the guide member has a recessed portion for accommodating the roller unit while the feeding rollers are in the separated state.

5. The recording apparatus according to claim 4, wherein the guide member has openings or recesses for the feeding rollers to protrude from under the guide member toward the guide surface while the feeding rollers are in the separated state.

6. The recording apparatus according to claim 5, wherein while the feeding rollers protrude toward the guide surface, the feeding rollers apply a transport force to the medium that has been fed from the recording region in the reverse direction.

7. A recording apparatus comprising:

a medium container configured to store a medium;

feeding rollers configured to be switched between a feeding state in which the feeding rollers are in contact with the medium that is stored in the medium container and a separated state in which the feeding rollers are separated from the medium that is stored in the medium container;

a reversing roller configured to reverse the medium that has been fed from the medium container;

a recorder configured to perform recording on the medium that has been reversed by the reversing roller, wherein the recorder performs the recording in a recording region; and a nip roller that is disposed on a side close to the medium container of the reversing roller, the nip roller being configured to nip with the reversing roller the medium that has been fed in the reverse direction from the recording region in which recording has been performed by the recorder, wherein the nip roller nips the medium fed in the reverse direction before the medium enters a medium transport path between the medium container and the recorder, wherein at least a portion of the feeding rollers that are in the separated state overlaps the nip roller in the direction of the height of the recording apparatus such that a bottom portion of the nip roller is below a top portion of the feeding rollers in the height direction, and the feeding rollers are positioned upstream of the nip roller with respect to a reversing path.

8. The recording apparatus according to claim 7, wherein the nip roller is disposed such that the nip roller is positioned to a side toward which the medium is to be bent by the reversing roller with respect to an axial central portion of the reversing roller in the depth direction of the recording apparatus.

* * * * *